US005726008A

United States Patent [19]

Maskasky

[11] Patent Number: 5,726,008

[45] Date of Patent: *Mar. 10, 1998

[54] PHOTOGRAPHIC ELEMENTS WITH IMPROVED VEHICLES

[75] Inventor: Joe Edward Maskasky, Rochester, N.Y.

[73] Assignee: Eastman Kodak Company, Rochester, N.Y.

[ * ] Notice: The term of this patent shall not extend beyond the expiration date of Pat. No. 5,604,085.

[21] Appl. No.: 715,572

[22] Filed: Sep. 18, 1996

[51] Int. Cl.[6] ..... G03C 1/005

[52] U.S. Cl. ..... 430/569; 430/567; 430/640; 430/641; 430/642; 430/643

[58] Field of Search ..... 430/567, 569, 430/642, 643, 641, 640

[56] References Cited

U.S. PATENT DOCUMENTS 5,284,744 2/1994 Maskasky ..... 430/569

5,604,085 2/1997 Maskasky ..... 430/567

OTHER PUBLICATIONS

Mees, The Theory of the Photographic Process, Rev. Ed., 1951, pp. 48 & 49.

James, The Theory of the Photographic Process, 4th Ed., 1977, p. 51.

Research Disclosure, vol. 365, Sep. 1994, Item 36544, II.

Research Disclosure, vol. 176, Dec. 1978, Item 17643, IX.

Keller, Sciences and Technology of Photography, VCH, 1993, p. 58.

*Primary Examiner*—Thorl Chea
*Attorney, Agent, or Firm*—Carl O. Thomas

[57] ABSTRACT

A photographic element is disclosed comprised of a layer containing radiation-sensitive silver halide grains and a vehicle which can be chill set and is in part derived from gelatin and in part derived from water dispersible starch.

13 Claims, No Drawings

PHOTOGRAPHIC ELEMENTS WITH IMPROVED VEHICLES

FIELD OF THE INVENTION

The invention relates to photographic elements containing at least one radiation-sensitive silver halide emulsion.

DEFINITION OF TERMS

The term "equivalent circular diameter" or "ECD" is employed to indicate the diameter of a circle having the same projected area as a silver halide grain.

The term "aspect ratio" designates the ratio of grain ECD to grain thickness (t).

The term "tabular grain" indicates a grain having two parallel crystal faces which are clearly larger than any remaining crystal face and having an aspect ratio of at least 2.

The term "tabular grain emulsion" refers to an emulsion in which tabular grains account for greater than 50 percent of total grain projected area.

The term "high bromide" or "high chloride" in referring to grains and emulsions indicates that bromide or chloride, respectively, are present in concentrations of greater than 50 mole percent, based on total silver.

In referring to grains and emulsions containing two or more halides, the halides are named in order of ascending concentrations.

The term "{111} tabular" or "{100} tabular" is employed to indicate tabular grains and tabular grain emulsions in which the tabular grains have {111} or {100} major faces, respectively.

The terms "gelatino-peptizer" and "gelatino-vehicle" are employed to designate peptizer and vehicle, respectively, derived from gelatin-i.e., gelatin and gelatin derivatives.

The term "cationic" or "anionic" in referring to starch indicates that the starch molecule has a net positive or negative charge, respectively, at the pH of intended use.

The term "non-ionic" in referring to starch indicates that the starch has no significant net charge at the pH of intended use.

The term "non-cationic" in referring to starch indicates a starch that is anionic or non-ionic.

The term "water dispersible" in referring to cationic starches indicates that, after boiling the cationic starch in water for 30 minutes, the water contains, dispersed to at least a colloidal level, at least 1.0 percent by weight of the total cationic starch.

The term "chill set" refers to an aqueous vehicle or coating that solidifies prior to drying at a temperature less than 30° C. and above 0° C.

The term "derived from" in referring to hydrophilic colloids derived from starch or gelatin includes both starch and modified forms of starch or gelatin and modified forms of gelatin.

The term "middle chalcogen" designates sulfur, selenium and/or tellurium.

Research Disclosure is published by Kenneth Mason Publications, Ltd., Dudley House, 12 North St., Emsworth, Hampshire P010 7DQ, England

BACKGROUND

Photographic emulsions are comprised of a dispersing medium and silver halide microcrystals, commonly referred to as grains. As the grains are precipitated from an aqueous medium, a peptizer, usually a hydrophilic colloid, is adsorbed to the grain surfaces to prevent the grains from agglomerating. Subsequently binder is added to the emulsion and, after coating, the emulsion is dried. The peptizer and binder are collectively referred to as the photographic vehicle of an emulsion.

The peptizer and the major portion of the remainder of the vehicle in the overwhelming majority of silver halide photographic elements is a gelatino-vehicle. An appreciation of gelatin is provided by this description contained in Mees *The Theory of the Photographic Process,* Revised Ed., Macmillan, 1951, pp. 48 and 49:

> Gelatin is pre-eminently a substance with a history; its properties and its future behavior are intimately connected with its past. Gelatin is closely akin to glue. At the dawn of the Christian era, Pliny wrote, "Glue is cooked from the hides of bulls." It is described equally shortly by a present-day writer as "the dried down soup or consommé of certain animal refuse." The process of glue making is age-old and consists essentially in boiling down hide clippings or bones of cattle and pigs. The filtered soup is allowed to cool and set to a jelly which, when cut and dried on nets, yields sheets of glue or gelatin, according to the selection of stock and the process of manufacture. In the preparation of glue, extraction is continued until the ultimate yield is obtained from the material; in the case of gelatin, however, the extraction is halted earlier and is carried out at lower temperatures, so that certain strongly adhesive but non-jelling constituents of glue are not present in gelatin. Glue is thus distinguished by its adhesive properties; gelatin by its cohesive properties, which favor the formation of strong jellies.
>
> Photographic gelatin is generally made from selected clippings of calf hide and ears as well as cheek pieces and pates. Pigskin is used for the preparation of some gelatin, and larger quantities are made from bone. The actual substance in the skin furnishing the gelatin is collagen. It forms about 35 per cent of the coria of fresh cattle hide. The corresponding tissue obtained from bone is termed ossein. The raw materials are selected not only for good structural quality but for freedom from bacterial decomposition. In preparation for the extraction, the dirt with loose flesh and blood is eliminated in a preliminary wash. The hair, fat, and much of the albuminous materials are removed by soaking the stock in limewater containing suspended lime. The free lime continues to rejuvenate the solution and keeps the bath at suitable alkalinity. This operation is followed by deliming with dilute acid, washing, and cooking to extract the gelatin. Several "cooks" are made at increasing temperatures, and usually the products of the last extractions are not employed for photographic gelatin. The crude gelatin solution is filtered, concentrated if necessary, cooled until it sets, cut up, and dried in slices. The residue, after extraction of the gelatin, consists chiefly of elastin and reticulin with some keratin and albumin.
>
> Gelatin may also be made by an acid treatment of the stock without the use of lime. The stock is treated with dilute acid (pH 4.0) for one to two months and then washed thoroughly, and the gelatin is extracted. This gelatin differs in properties from gelatin made by treatment with lime.

In addition to the collagen and ossein sought to be extracted in the preparation of gelatin there are, of course, other materials entrained. For example, James *The Theory of the Photographic Process,* 4th Ed., Macmillan, 1977, p. 51, states:

> Although collagen generally is the preponderant protein constituent in its tissue of origin, it is always associated with various "ground substances" such as noncollagen protein, mucopolysaccharides, polynucleic acid, and lipids. Their more or less complete removal is desirable in the preparation of photographic gelatin.

Superimposed on the complexity of composition is the variability of composition, attributable to the varied diets of the animals providing the starting materials. The most notorious example of this was provided by the forced suspension of manufacturing by the Eastman Dry Plate Company in 1882, ultimately attributed to a reduction in the sulfur content in a purchased batch of gelatin.

Considering the time, effort, complexity and expense involved in gelatin preparation, it is not surprising that research efforts have in the past been mounted to replace the gelatin used in photographic emulsions and other film layers. However, by 1970 any real expectation of finding a generally acceptable replacement for gelatin had been abandoned. A number of alternative materials have been identified as having peptizer utility, but none have found more than limited acceptance. Of these, cellulose derivatives are by far the most commonly named, although their use has been restricted by the insolubility of cellulosic materials and the extensive modifications required to provide peptizing utility.

*Research Disclosure,* Vol. 365, Sept. 1994, Item 36544, II. Vehicles, vehicle extenders, vehicle-like addenda and vehicle related addenda, A. Gelatin and hydrophilic colloid peptizers, paragraph (1) states:

> (1) Photographic silver halide emulsion layers and other layers on photographic elements can contain various colloids alone or in combination as vehicles. Suitable hydrophilic materials include both naturally occurring substances such as proteins, protein derivatives, cellulose derivatives—e.g., cellulose esters, gelatin—e.g., alkali-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like . . .

This description is identical to that contained in *Research Disclosure,* Vol. 176, December 1978, Item 17643, IX. Vehicles and vehicle extenders, paragraph A.

One of the major advantages in photographic element construction of gelatino-vehicle that has contributed to its extensive use, despite its variability and complex manufacture, results from the ability of gelatino-vehicle containing layers to be chill set immediately following coating, described by Keller, *Science and Technology of Photography,* VCH, 1993, at page 58 as "its ability to solidify below 30° C." This allows a support with one or more freshly deposited gelatino-vehicle coatings to be transported non-horizontally (e.g., vertically and over guide rollers) during the course of drying while maintaining physically uniform coatings. Chill setting of the gelatino-vehicle allows relatively compact and efficient drying chamber constructions that in turn facilitate very high coating rates. Although many known aqueous coating compositions are capable of forming transparent coatings on drying, few have the ability to form uniform coatings with physical integrity prior to drying.

Maskasky (I) U.S. Pat. No. 5,284,744 teaches the use of potato starch as a peptizer for silver halide emulsions and also suggests the option of employing the starch as binder.

RELATED APPLICATIONS

Maskasky (II) U.S. Pat. No. 5,620,840, discloses that high bromide {111} tabular grain emulsions can be prepared employing a cationic starch as a peptizer.

Maskasky (III) U.S. Pat. No. 5,604,085, discloses that high bromide ultrathin tabular grain emulsions can be prepared by employing a cationic starch as a peptizer.

Maskasky (VI) U.S. Pat. No. 5,607,828, discloses high chloride {100} tabular grain emulsions prepared in the presence of an oxidized cationic starch.

Maskasky (VII) U.S. Pat. No. 5,629,142, discloses dual coated radiographic elements in which at least that portion of the vehicle acting as a peptizer for silver halide grains is derived from a water dispersible cationic starch.

Maskasky (IV) U.S. Ser. No. 08/662,300, filed May 12, 1996, commonly assigned, titled PHOTOGRAPHIC EMULSIONS IMPROVED BY PEPTIZER MODIFICATION, now allowed discloses silver halide emulsions containing an oxidized cationic starch as a peptizer.

Maskasky (V) U.S. Ser. No. 08/662,904, filed May 12, 1996, commonly assigned, titled HIGH BROMIDE ULTRATHIN TABULAR GRAIN EMULSIONS IMPROVED BY PEPTIZER MODIFICATION, now allowed discloses high bromide ultrathin {111} tabular grain emulsions prepared in the presence of an oxidized cationic starch.

SUMMARY OF THE INVENTION

In one aspect this invention relates to a photographic element comprising a support and, coated on the support, at least one silver halide emulsion layer comprised of radiation-sensitive silver halide grains and hydrophilic colloid vehicle, wherein at least 45 percent of the total weight of the hydrophilic colloid vehicle is derived from gelatin and at least 20 percent of the total weight of the hydrophilic colloid vehicle is derived from a water dispersible starch.

It has been discovered quite unexpectedly that the advantageous physical properties of gelatino-vehicle coatings can be retained when a significant portion of the gelatin derived vehicle is replaced by a water dispersible starch. Specifically, it was entirely unexpected that the chill setting properties of the mixed vehicle coatings could be retained, since starch is incapable of chill setting. Contrary to the observations of Maskasky II–VII, which specifically teach the use peptizers derived from cationic starch, the starch derived vehicles of the photographic elements of the invention can be derived from any water dispersible starch, including non-cationic starches.

Thus, the invention is based on the discovery of combinations of mutually compatible starch derived and gelatin derived vehicle components that reduce dependence on gelatin derived vehicle while retaining the desirable chemical and physical characteristics of gelatino-vehicle photographic elements.

DESCRIPTION OF PREFERRED EMBODIMENTS

In the simplest contemplated form of the invention a photographic element satisfying the requirements of the invention can consist of a photographic support and, coated on the support, a radiation-sensitive silver halide emulsion layer. This structure is illustrated by the following:

| (Element I) |
| --- |
| Silver Halide Emulsion Layer<br>Support |

In Element I the support can take any convenient conventional form. Suitable supports are illustrated by *Research Disclosure,* Vol. 365, September 1994, Item 36544, XV. Supports. The support can be transparent (typically clear or blue tinted for medical diagnostic imaging) or reflective (typically white). In almost all instances the support includes one or more coatings or other surface modification to promote adhesion of the radiation-sensitive silver halide emulsion layer.

The silver halide emulsion layer contains, as an absolute minimum, radiation-sensitive silver halide grains and a hydrophilic colloid vehicle. The radiation-sensitive silver halide grains form a solid, discontinuous phase within the coating while the vehicle forms a continuous phase that separates the grains and binds them into a cohesive layer. To avoid agglomeration of the grains, a portion of the vehicle, referred to as a peptizer, is introduced into the emulsion during grain precipitation (including grain nucleation and growth). After precipitation and in the course of preparing the emulsion for coating, the remainder of the vehicle is added to act as a binder for the coating. Conventional hydrophilic colloid peptizers are commonly employed also as binders. When the same vehicle materials are employed both as peptizer and binder, the peptizer and binder merge into a unitary vehicle. It is common practice to include in the hydrophilic colloid vehicle used as a binder one or more dispersed materials to modify performance or physical properties, such as latex polymers, which are neither hydrophilic colloids nor capable being employed alone as either a peptizer or a binder. Such materials are commonly referred to as vehicle extenders. Conventional hydrophilic colloid vehicles, including peptizers and binders, as well as vehicle extenders are illustrated by *Research Disclosure,* Item 36544, cited above, II. Vehicles, vehicle extenders, vehicle-like addenda and vehicle related addenda.

In the practice of the present invention it is contemplated to employ a gelatin derived vehicle amounting at least 45 percent by weight of the total vehicle forming the silver halide emulsion layer. The function of the gelatin derived vehicle is to impart to the silver halide emulsion layer the capability of being chill set.

Conventionally and in the practice of this invention an aqueous composition containing the materials intended to form the silver halide emulsion layer and water, which together render the aqueous composition optimally flowable for coating uniformity, is coated onto the support. Typically and in virtually all high volume manufacture, the support is continuously advanced past a coating station and immediately thereafter cooled to chill set the silver halide emulsion layer while it still contains water intended to be subsequently removed by evaporation. Although coating composition formulations can allow chill setting to be achieved at temperatures approaching 30° C., in practice it is typically preferred to coat at or near ambient temperatures and to chill set the coating by bringing the support into thermally conductive contact with a hollow receptacle containing water maintained near freezing-e.g., in the range of from just greater than 0° C. to 10° C. Once chill setting has occurred, the coated support can be guided over various guide rollers while evaporative loss of excess moisture from the coating is occurring without creating runs, drips or other objectionable non-uniformities in the coating.

To reduce the gelatino-vehicle requirements of the photographic element and thereby simplify manufacture of the photographic element by substituting a more abundant, controllable and easier to prepare hydrophilic colloid vehicle without sacrificing the chill setting capability of the coating composition, it is proposed to incorporate at least 20 percent of the total weight of the hydrophilic colloid vehicle in the form of a hydrophilic colloid vehicle derived from a water dispersible starch.

Although starches have been suggested for use as hydrophilic colloid vehicles in photographic elements, it has been generally assumed that the disadvantage of starch addition at any above very minor concentrations is loss of the ability to chill set the starch containing coating, a major manufacturing disadvantage. It has been discovered that very substantial proportions of the hydrophilic colloid vehicle can be derived from water dispersible starch while retaining the ability to chill set photographic element coatings. Specifically, it is contemplated that from 20 (preferably 30) to 55 (preferably 50) percent of the hydrophilic colloid vehicle forming the silver halide emulsion layer, based on the total weight hydrophilic colloid forming the silver halide emulsion layer, be present in the form hydrophilic colloid derived from a water dispersible starch. In most instances it is specifically preferred to employ the minimum proportion of the hydrophilic colloid vehicle in the form of gelatin derived hydrophilic colloid that is required for chill setting.

Both the gelatino-vehicle and the hydrophilic colloid vehicle derived from water dispersible starch are capable of performing each of the peptizer and binder functions of the vehicle. Therefore, it is recognized that either the gelatin derived or starch derived components of the hydrophilic colloid vehicle forming the silver halide emulsion layer can provide all of the peptizer used in preparing the radiation-sensitive silver halide grains. Alternatively, both gelatin derived and starch derived hydrophilic colloids can be sequentially or concurrently introduced as silver halide grain peptizers. However, to simplify emulsion preparation, it is usually preferred to employ only one of these two components as peptizers. Although in some applications it may be convenient to partition the gelatin derived and starch derived vehicle components so that one is added only during grain precipitation to act as a peptizer and the other is added entirely later to act as a binder, in most instances it is contemplated that the vehicle added following grain precipitation will contain both the gelatin derived and starch derived components in proportions chosen to realize optimum overall relative proportions of these hydrophilic colloid components.

The precipitation of the radiation-sensitive silver halide grains in the presence of gelatino-peptizers can be undertaken in any convenient conventional manner. Silver halide emulsions that can be prepared using gelatino-peptizers are illustrated by *Research Disclosure,* Item 36544, cited above, I. Emulsion grains and their preparation.

Preferably, the precipitation of the silver halide grains of the photographic elements of the invention is conducted in the presence of hydrophilic colloid peptizer derived from starch.

The term "starch" is employed to include both natural starch and modified derivatives, such as dextrinated, hydrolyzed, oxidized, alkylated, hydroxyalkylated, acetylated or fractionated starch. The starch can be of any origin, such as corn starch, wheat starch, potato starch, tapioca starch, sago starch, rice starch, waxy corn starch or high amylose corn starch. Illustrations of varied types of "starch" are set out by Whistler et al *Starch Chemistry and Technology*, 2nd Ed., Academic Press, 1984.

Starches are generally comprised of two structurally distinctive polysaccharides, α-amylose and amylopectin. Both are comprised of α-D-glucopyranose units. In α-amylose the α-D-glucopyranose units form a 1,4-straight chain polymer. The repeating units take the following form:

(I)

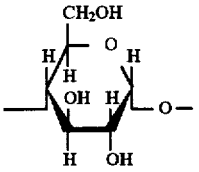

In amylopectin, in addition to the 1,4-bonding of repeating units, 6-position chain branching (at the site of the —$CH_2OH$ group above) is also in evidence, resulting in a branched chain polymer. The repeating units of starch and cellulose are diasteroisomers that impart different overall geometries to the molecules. The α anomer, found in starch and shown in formula I above, results in a polymer that is capable of crystallization and some degree of hydrogen bonding between repeating units in adjacent molecules, but not to the same degree as the β anomer repeating units of cellulose and cellulose derivatives. Polymer molecules formed by the β anomers show strong hydrogen bonding between adjacent molecules, resulting in clumps of polymer molecules and a much higher propensity for crystallization. Lacking the alignment of substituents that favors strong intermolecular bonding, found in cellulose repeating units, starch and starch derivatives are much more readily dispersed in water.

To be useful as a peptizer the starch must be water dispersible. Many starches disperse in water upon heating to temperatures up to boiling for a short time (e.g., 5 to 30 minutes). It is common practice also to disperse starch in water at higher temperatures by heating at elevated pressure. High sheer mixing also facilitates starch dispersion. The presence of ionic substituents increases the polar character of the starch molecule and facilitates dispersion. The starch molecules preferably entirely achieve at least a colloidal level of dispersion and ideally are dispersed at a molecular level—i.e., dissolved.

Any water dispersible hydrophilic colloid derived from starch can be employed as a peptizer. Specific illustrations of starch being employed as a peptizer are provided by *Research Disclosure*, Item 36544, II., cited above, A. Gelatin and hydrophilic colloid peptizers, and Maskasky I, cited above. The starch can be cationic, anionic or non-ionic in preparing silver halide emulsions other than tabular grain emulsions. Thus, non-tabular grain emulsions can be prepared as illustrated by *Research Disclosure*, Item 36544, I. Emulsion grains and their preparation, cited above, merely by substituting for gelatino-peptizer and any hydrophilic colloid derived from starch, including any of the various forms more specifically described below.

It is preferred in connection with silver halide grain precipitation generally and necessary in preparing tabular grain emulsions to employ a water dispersible starch or derivative as a peptizer that is cationic—that is, that contains an overall net positive charge when dispersed in water. Starches are conventionally rendered cationic by attaching a cationic substituent to the α-D-glucopyranose units, usually by esterification or etherification at one or more free hydroxyl sites. Reactive cationogenic reagents typically include a primary, secondary or tertiary amino group (which can be subsequently protonated to a cationic form under the intended conditions of use) or a quaternary ammonium, sulfonium or phosphonium group.

The following teachings, the disclosures of which are here incorporated by reference, illustrate water dispersible cationic starches within the contemplation of the invention:

Rutenberg et al U.S. Pat. No. 2,989,520;
Meisel U.S. Pat. No. 3,017,294;
Elizer et al U.S. Pat. No. 3,051,700;
Aszolos U.S. Pat. No. 3,077,469;
Elizer et al U.S. Pat. No. 3,136,646;
Barber et al U.S. Pat. No. 3,219,518;
Mazzarella et al U.S. Pat. No. 3,320,080;
Black et al U.S. Pat. No. 3,320,118;
Caesar U.S. Pat. No. 3,243,426;
Kirby U.S. Pat. No. 3,336,292;
Jarowenko U.S. Pat. No. 3,354,034;
Caesar U.S. Pat. No. 3,422,087;
Dishburger et al U.S. Pat. No. 3,467,608;
Beaninga et al U.S. Pat. No. 3,467,647;
Brown et al U.S. Pat. No. 3,671,310;
Cescato U.S. Patent 3,706,584;
Jarowenko et al U.S. Pat. No. 3,737,370;
Jarowenko U.S. Pat. No. 3,770,472;
Moser et al U.S. Pat. No. 3,842,005;
Tessler U.S. Pat. No. 4,060,683;
Rankin et al U.S. Pat. No. 4,127,563;
Huchette et al U.S. Pat. No. 4,613,407;
Blixt et al U.S. Pat. No. 4,964,915;
Tsai et al U.S. Pat. No. 5,227,481; and
Tsai et al U.S. Pat. No. 5,349,089.

In a specifically preferred form the starch is oxidized. This is accomplished by treating the starch with a strong oxidizing agent. Both hypochlorite ($ClO^-$) or periodate ($IO_4^-$) have been extensively used and investigated in the preparation of commercial starch derivatives and are preferred. While any convenient counter ion can be employed, preferred counter ions are those fully compatible with silver halide emulsion preparation, such as alkali and alkaline earth cations, most commonly sodium, potassium or calcium.

When the oxidizing agent opens the α-D-glucopyranose ring, the oxidation sites are at the 2 and 3 position carbon atoms forming the α-D-glucopyranose ring. The 2 and 3 position

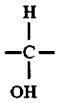

groups are commonly referred to as the glycol groups. The carbon-to-carbon bond between the glycol groups is replaced in the following manner:

(II)

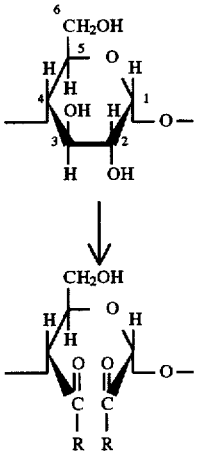

where R represents the atoms completing an aldehyde group or a carboxyl group.

The hypochlorite oxidation of starch is most extensively employed in commercial use. The hypochlorite is used in small quantities (<0.1% by weight chlorine, based on total starch) to modify impurities in starch, most notably to bleach colored impurities. Any modification of the starch at these low levels is minimal, at most affecting only the polymer chain terminating aldehyde groups, rather than the α-D-glucopyranose repeating units themselves. At levels of oxidation that affect the α-D-glucopyranose repeating units the hypochlorite affects the 2, 3 and 6 positions, forming aldehyde groups at lower levels of oxidation and carboxyl groups at higher levels of oxidation. Oxidation is conducted at mildly acidic or alkaline pH (e.g., >5 to 11). The oxidation reaction is exothermic, requiring cooling of the reaction mixture. Temperatures of less than 45° C. are preferably maintained. Using a hypobromite oxidizing agent is known to produce similar results as hypochlorite.

Hypochlorite oxidation is catalyzed by the presence of bromide ions. Since silver halide emulsions are conventionally precipitated in the presence of a stoichiometric excess of the halide to avoid inadvertent silver ion reduction (fogging), it is conventional practice to have bromide ions in the dispersing media of high bromide silver halide emulsions. Thus, it is specifically contemplated to add bromide ion to the starch prior to performing the oxidation step in the concentrations known to be useful in the precipitation of silver halide emulsions.

Cescato U.S. Pat. No. 3,706,584, the disclosure of which is here incorporated by reference, discloses techniques for the hypochlorite oxidation of starch. Sodium bromite, sodium chlorite and calcium hypochlorite are named as alternatives to sodium hypochlorite. Further teachings of the hypochlorite oxidation of starches is provided by the following: R. L. Whistler, E. G. Linke and S. Kazeniac, "Action of Alkaline Hypochlorite on Corn Starch Amylose and Methyl 4-O-Methyl-D-glucopyranosides", *Journal Amer. Chem. Soc.*, Vol. 78, pp. 4704–9 (1956); R. L. Whistler and R. Schweiger, "Oxidation of Amylopectin with Hypochlorite at Different Hydrogen Ion Concentrations", *Journal Amer. Chem. Soc.*, Vol. 79, pp. 6460–6464 (1957); J. Schmorak, D. Mejzler and M. Lewin, "A Kinetic Study of the Mild Oxidation of Wheat Starch by Sodium Hypochloride in the Alkaline pH Range", *Journal of Polymer Science*, Vol. XLIX, pp. 203–216 (1961); J. Schmorak and M. Lewin, "The Chemical and Physico-chemical Properties of Wheat Starch with Alkaline Sodium Hypochlorite", *Journal of Polymer Science: Part A*, Vol. 1, pp. 2601–2620 (1963); K. F. Patel, H. U. Mehta and H. C. Srivastava, "Kinetics and Mechanism of Oxidation of Starch with Sodium Hypochlorite", *Journal of Applied Polymer Science*, Vol. 18, pp. 389–399 (1974); R. L. Whistler, J. N. Bemiller and E. F. Paschall, *Starch: Chemistry and Technology*, Chapter X, Starch Derivatives: Production and Uses, II. Hypochlorite-Oxidized Starches, pp. 315–323, Academic Press, 1984; and O. B. Wurzburg, *Modified Starches: Properties and Uses*, III. Oxidized or Hypochlorite-Modified Starches, pp. 23–28 and pp. 245–246, CRC Press (1986). Although hypochlorite oxidation is normally carried out using a soluble salt, the free acid can alternatively be employed, as illustrated by M. E. McKillican and C. B. Purves, "Estimation of Carboxyl, Aldehyde and Ketone Groups in Hypochlorous Acid Oxystarches", *Can. J. Chem.*, Vol. 312–321 (1954).

Periodate oxidizing agents are of particular interest, since they are known to be highly selective. The periodate oxidizing agents produce starch dialdehydes by the reaction shown in the formula (II) above without significant oxidation at the site of the 6 position carbon atom. Unlike hypochlorite oxidation, periodate oxidation does not produce carboxyl groups and does not produce oxidation at the 6 position. Mehltretter U.S. Pat. No. 3,251,826, the disclosure of which is here incorporated by reference, discloses the use of periodic acid to produce a starch dialdehyde which is subsequently modified to a cationic form. Mehltretter also discloses for use as oxidizing agents the soluble salts of periodic acid and chlorine. Further teachings of the periodate oxidation of starches is provided by the following: V. C. Barry and P. W. D. Mitchell, "Properties of Periodate-oxidised Polysaccharides. Part II. The Structure of some Nitrogen-containing Polymers", *Journal Amer. Chem. Soc.*, 1953, pp. 3631–3635; P. J. Borchert and J. Mirza, "Cationic Dispersions of Dialdehyde Starch I. Theory and Preparation", *Tappi*, Vol. 47, No. 9, pp. 525–528 (1964); J. E. McCormick, "Properties of Periodate-oxidised Polysaccharides. Part VII. The Structure of Nitrogen-containing Derivatives as deduced from a Study of Monosaccharide Analogues", *Journal Amer. Chem. Soc.*, pp. 2121–2127 (1966); and O. B. Wurzburg, *Modified Starches: Properties and Uses*, III. Oxidized or Hypochlorite-Modified Starches, pp. 28–29, CRC Press (1986).

Starch oxidation by electrolysis is disclosed by F. F. Farley and R. M. Hixon, "Oxidation of Raw Starch Granules by Electrolysis in Alkaline Sodium Chloride Solution", *Ind. Eng. Chem.*, Vol. 34, pp. 677–681 (1942).

Depending upon the choice of oxidizing agents employed, one or more soluble salts may be released during the oxidation step. Where the soluble salts correspond to or are similar to those conventionally present during silver halide precipitation, the soluble salts need not be separated from the oxidized starch prior to silver halide precipitation. It is, of course, possible to separate soluble salts from the oxidized cationic starch prior to precipitation using any conventional separation technique. For example, removal of halide ion in excess of that desired to be present during grain precipitation can be undertaken. Simply decanting solute and dissolved salts from oxidized cationic starch particles is a simple alternative. Washing under conditions that do not solubilize the oxidized cationic starch is another preferred option. Even if the oxidized starch is dispersed in a solute during oxidation, it can be separated using conventional ultrafiltration techniques, since there is a large molecular size separation between the oxidized starch and soluble salt by-products of oxidation.

The carboxyl groups formed by oxidation take the form —C(O)OH, but, if desired, the carboxyl groups can, by further treatment, take the form —C(O)OR', where R' represents the atoms forming a salt or ester. Any organic moiety added by esterification preferably contains from 1 to 6 carbon atoms and optimally from 1 to 3 carbon atoms.

The minimum degree of oxidation contemplated is that required to reduce the viscosity of the starch. It is generally accepted (see citations above) that opening an α-D-glucopyranose ring in a starch molecule disrupts the helical configuration of the linear chain of repeating units which in turn reduces viscosity in solution. It is contemplated that at least one glucopyranose repeating unit per starch polymer, on average, be ring opened in the oxidation process. As few as two or three opened α-D-glucopyranose rings per polymer has a profound effect on the ability of the starch polymer to maintain a linear helical configuration. It is generally preferred that at least 1 percent of the glucopyranose rings be opened by oxidation.

A preferred objective is to reduce the viscosity of the starch by oxidation to less than four times (400 percent of) the viscosity of water at the starch concentrations employed in silver halide precipitation. Although this viscosity reduction objective can be achieved with much lower levels of oxidation, starch oxidations of up to 90 percent of the α-D-glucopyranose repeating units have been reported (Wurzburg, cited above, p. 29). However, it is generally preferred to avoid driving oxidation beyond levels required for viscosity reduction, since excessive oxidation results in increased chain cleavage. A typical convenient range of oxidation ring-opens from 3 to 50 percent of the α-D-glucopyranose rings.

In substituting starch derived peptizers for gelatino-peptizers, a few significant differences can be observed. First, whereas conventionally gelatino-silver halide precipitations are conducted in the temperature range of from 30° to 90° C., in the preparation of emulsions employing starch-derived peptizer the temperature of precipitation can range down to room temperature or even below. For example, precipitation temperatures as low as 0° C. are within the contemplation of the invention. Unlike gelatino-peptizers, starch-derived peptizer does not "set up" at reduced temperatures. Oxidized starches show particularly attractive low viscosities at lower temperatures.

The peptized radiation-sensitive silver halide grains can be of any conventional silver halide composition, including silver bromide, silver chloride, silver iodide (including >90 mole percent iodide grains in all possible halide combinations), silver iodobromide, silver chlorobromide, silver bromochloride, silver iodochlorobromide, silver chloroiodobromide, and silver iodobromochloride.

Radiation-sensitive silver halide grains typically have mean equivalent circular diameters (ECD's) of at least 0.1 μm. For tabular grain emulsions maximum useful mean ECD's can range above 10 μm. However, even tabular grains rarely have ECD's in excess of 5 μm. Nontabular grains seldom exhibit grain sizes in excess of 2 μm.

Although starch derived hydrophilic colloids are highly effective peptizers, preventing clumping of silver halide grains as they are formed and grown, use of the starch derived peptizer does not in all instances result in the formation of grains of the same shape, size and dispersity that would be formed in the presence of a gelatino-peptizer. For example, cationic starch shows a much greater propensity toward the formation of grains having {111} crystal faces. This, of course, is highly advantageous in substituting cationic starch for conventional peptizers in emulsion preparations that conventionally produce grains having {111} crystal faces, such as octahedra and tabular grains, including ultrathin (<0.07 μm) tabular grains, having {111} crystal faces. However, in precipitations that require grain growth modifiers to control crystal habit, varied grain characteristics are obtained, depending upon the specific grain growth modifier present.

A specifically preferred application for cationic starch peptizer is in the preparation of high (>50 mole percent, based on silver) bromide {111} tabular grain emulsions. The procedures for high bromide {111} tabular grain emulsion preparation through the completion of tabular grain growth require only the substitution of cationic starch peptizer, preferably in its oxidized form, for conventional gelatino-peptizers. The following high bromide {111} tabular grain emulsion precipitation procedures, here incorporated by reference, are specifically contemplated to be useful in the practice of the invention, subject to the substitution of cationic starch peptizer in any of the forms discussed above:

Daubendiek et al U.S. Pat. No. 4,414,310;
Abbott et al U.S. Pat. No. 4,425,426;
Wilgus et al U.S. Pat. No. 4,434,226;
MaskaskyU.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitouet al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The high bromide {111} tabular grain emulsions that are formed preferably contain at least 70 mole percent bromide and optimally at least 90 mole percent bromide, based on silver. Silver bromide, silver iodobromide, silver chlorobromide, silver iodo-chlorobromide, and silver chloroiodobromide tabular grain emulsions are specifically contemplated. Although silver chloride and silver bromide form tabular grains in all proportions, chloride is preferably present in concentrations of 30 mole percent or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent. It is generally preferred that the iodide concentration be less than 20 mole percent. Significant photographic advantages can be realized with iodide concentrations as low as 0.5 mole percent, with an iodide concentration of at least 1 mole percent being preferred.

It is additionally contemplated to prepare high chloride {100} tabular grain emulsions by employing a starch derived peptizer. Conventional procedures for high chloride {100} tabular grain emulsion preparation through the completion of tabular grain growth can be modified by the substitution of starch derived peptizer for gelatino-peptizers. Thus, the procedures for preparing high chloride {100} tabular grain emulsions disclosed by Maskasky U.S. Pat. Nos. 5,264,337 and 5,292,632, Szajewski U.S. Pat. No. 5,310,635, Brust et al U.S. Pat. No. 5,314,798, House et al U.S. Pat. No. 5,320,938, Chang et al U.S. Pat. No. 5,413,904, and Budz et al U.S. Pat. No. 5,451,490, the disclosures of which are incorporated by reference, are contemplated to be practiced merely by substituting starch derived peptizer for the disclosed gelatino-peptizer. Precipitation techniques include those that employ iodide during grain nucleation (e.g., House et al) or immediately following grain nucleation (e.g., Chang et al) or that withhold the introduction of iodide during grain nucleation and rely instead upon adsorbed grain growth modifiers to provide the formation of high chloride {100} tabular grains (e.g., Maskasky). In addition, Maskasky U.S. Pat. No. 5,292,632 in Example 6 demonstrates that neither iodide nor a grain growth modifier are necessary to the precipitation of high chloride {100} tabular grain emulsions, although the percentage of total grain projected area accounted by high chloride {100} tabular grains is not as high as demonstrated with the other preparation techniques.

The high chloride {100} tabular grain population contains at least 50 mole percent chloride, based on total silver forming the grain population (herein also referred to simply as total silver). Thus, the silver halide content of the grain population can consist essentially of silver chloride as the sole silver halide. Alternatively, the grain population can consist essentially of silver bromochloride, where bromide ion accounts for up to 50 mole percent of the silver halide, based on total silver. Preferred emulsions according to the invention contain less than 20 mole percent bromide, optimally less than 10 mole percent bromide, based on total silver. Silver iodo-chloride and silver iodobromochloride emulsions are also within the contemplation of the invention. It is well understood in the art that low bromide and/or iodide concentrations at grain surfaces can significantly improve the properties of the grains for photographic purposes such as spectral sensitization. Bromide and/or iodide added for the purpose of improving sensitization can usefully be precipitated onto the surface of a previously formed tabular grain population—e.g., a silver chloride tabular grain population. Significant photographic advantages can be realized with bromide or iodide concentrations as low as 0.1 mole percent, based on total silver, with minimum concentrations preferably being at least 0.5 mole percent.

The tabular grain emulsions can exhibit mean grain ECD's of any conventional value. In practice, the tabular grain emulsions of the invention typically exhibit a mean ECD in the range of from about 0.2 to 5.0 μm. Tabular grain thicknesses typically range from about 0.03 μm to 0.3 μm. For blue recording somewhat thicker grains, up to about 0.5 μm, can be employed. For minus blue (red and/or green) recording, thin (<0.2 μm) tabular grains are preferred.

Ultrathin (<0.07 μm) tabular grains are specifically preferred for most minus blue recording in photographic elements forming dye images (i.e., color photographic elements). An important distinction between ultrathin tabular grains and those having greater (≧0.07 μm) thicknesses resides in the difference in their reflective properties. Ultrathin tabular grains exhibit little variation in reflection as a function of the wavelength of visible light to which they are exposed, whereas thicker tabular grains exhibit pronounced reflection maxima and minima as a function of the wavelength of light. Hence ultrathin tabular grains simplify construction of photographic element intended to form plural color records (i.e., color photographic elements). This property, together with the more efficient utilization of silver attributable to ultrathin grains, provides a strong incentive for their use in color photographic elements.

On the other hand, otherwise comparable tabular grain emulsions used to form silver images differing in tabular grain thickness produce colder image tones on processing as tabular grain thickness is increased. Colder image tones are sought particularly in radiographic images, but they are also sought in variety of black-and-white photography applications.

Except for the wavelength dependence of reflectance and image tone, noted above, the advantages that tabular grains impart to emulsions generally increases as the average aspect ratio of the tabular grain emulsions increases and, particularly increases as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 μm (preferably less than 0.2 μm and optimally less than 0.07 μm) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80.

Conventional dopants can be incorporated into the silver halide grains during their precipitation, as illustrated by the patents cited above and *Research Disclosure,* Item 36544, cited above, Section I. Emulsion grains and their preparation, D. Grain modifying conditions and adjustments, paragraphs (3), (4) and (5). It is specifically contemplated to incorporate shallow electron trapping site providing (SET) dopants in the grains as disclosed in *Research Disclosure,* Vol. 367, November 1994, Item 36736.

It is also recognized that silver salts can be epitaxially grown onto the grains during the precipitation process. Epitaxial deposition onto the edges and/or corners of grains is specifically taught by Maskasky U.S. Pat. Nos. 4,435,501 and 4,463,087, here incorporated by reference. In a specifically preferred form high chloride silver halide epitaxy is present at the edges or, most preferably, restricted to corner adjacent sites on the host grains.

Although epitaxy onto the host grains can itself act as a sensitizer, the emulsions of the invention show unexpected sensitivity enhancements with or without epitaxy when chemically sensitized in the absence of a gelatino-peptizer, employing one or a combination of noble metal, middle chalcogen and reduction chemical sensitization techniques. Conventional chemical sensitizations by these techniques are summarized in *Research Disclosure,* Item 36544, cited above, Section IV. Chemical sensitizations. All of these sensitizations, except those that specifically require the presence of gelatin (e.g., active gelatin sensitization) are applicable to the practice of the invention. It is preferred to employ at least one of noble metal (typically gold) and middle chalcogen (typically sulfur) and, most preferably, a combination of both in preparing the emulsions of the invention for photographic use.

Between emulsion precipitation and chemical sensitization, the step that is preferably completed before any gelatin or gelatin derivative is added to the emulsion, it is conventional practice to wash the emulsions to remove soluble reaction by-products (e.g., alkali and/or alkaline earth cations and nitrate anions). If desired, emulsion washing can be combined with emulsion precipitation, using ultrafiltration during precipitation as taught by Mignot U.S. Pat. No. 4,334,012. Alternatively emulsion washing by diafiltration after precipitation and before chemical sensitization can be undertaken with a semipermeable membrane as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS 2,436,461 and Bolton U.S. Pat. No. 2,495,918, or by employing an ion-exchange resin, as illustrated by Maley U.S. Pat. No. 3,782,953 and Noble U.S. Pat. No. 2,827,428. In washing by these techniques there is no possibility of removing the selected peptizers, since ion removal is inherently limited to removing much lower molecular weight solute ions and peptizer adsorbed to the grain surfaces cannot be removed by washing.

A specifically preferred approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

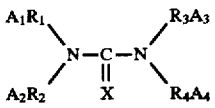

(III)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form. A specifically preferred tetrasubstituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

$$AuL_2^+X^-$$

or $$AuL(L^1)^+X^- \quad \text{(IV)}$$

wherein

L is a mesoionic compound;

X is an anion; and $L^1$ is a Lewis acid donor.

In another preferred form of the invention it is contemplated to employ alone or in combination with sulfur sensitizers, such as those of formula IV, and/or gold sensitizers, such as those of formula V, reduction sensitizers which are the 2-[N-(2-alkynyl)amino]-meta-chalcazoles disclosed by Lok et al U.S. Pat. Nos. 4,378,426 and 4,451,557, the disclosures of which are here incorporated by reference.

Preferred 2-[N-(2-alkynyl)amino]-meta-chalcazoles can be represented by the formula:

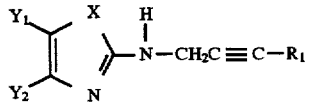

(V)

where

X=O, S, Se;

$R_1$=(Va) hydrogen or (Vb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

The formula V compounds are generally effective (with the Vb form giving very large speed gains and exceptional latent image stability) when present during the heating step (finish) that results in chemical sensitization.

Spectral sensitization of the emulsions of the invention is not required, but is highly preferred, even when photographic use of the emulsion is undertaken in a spectral region in which the grains exhibit significant native sensitivity. While spectral sensitization is most commonly undertaken after chemical sensitization, spectral sensitizing dye can be advantageous introduced earlier, up to and including prior to grain nucleation. Maskasky U.S. Pat. Nos. 4,435,501 and 4,463,087 teach the use of aggregating spectral sensitizing dyes, particularly green and red absorbing cyanine dyes, as site directors for epitaxial deposition. These dyes are present in the emulsion prior to the chemical sensitizing finishing step. When the spectral sensitizing dye present in the finish is not relied upon as a site director for the silver salt epitaxy, a much broader range of spectral sensitizing dyes is available. A general summary of useful spectral sensitizing dyes is provided by *Research Disclosure,* Item 36544, cited above, Section V. Spectral sensitization and desensitization.

While in specifically preferred forms of the invention the spectral sensitizing dye can act also as a site director and/or can be present during the finish, the only required function that a spectral sensitizing dye must perform in the emulsions of the invention is to increase the sensitivity of the emulsion to at least one region of the spectrum. Hence, the spectral sensitizing dye can, if desired, be added to an emulsion according to the invention after chemical sensitization has been completed.

After emulsion precipitation and sensitization additional vehicle is added as a binder to provide a coating composition for forming the silver halide emulsion layer. Subject to the overall gelatin derived and starch derived vehicle proportions described above, the binder can be independently selected from among the starch derived hydrophilic colloids described above for use as peptizers and other conventional vehicles (including non-hydrophilic components, such as vehicle extenders) of the type described in *Research Disclosure,* Item 36544, II., cited above.

Since the gelatin derived vehicle in all instances accounts for at least 45 percent by weight of the hydrophilic colloid vehicle forming the silver halide emulsion layer, conventional gelatino-vehicle hardeners of the type illustrated by *Research Disclosure,* Item 36544, II., cited above, B. Hardeners, are specifically contemplated. Since significant levels of starch derived vehicle are required, hardeners can be optionally selected from among conventional starch crosslinking agents. One of the most widely employed crosslinking agents for starch is epichlorohydrin. Other known crosslinking agents include β,β'-dichlorodiethyl ether; dibasic organic acids reacted under conditions such that both carboxyl groups esterify starch hydroxyl groups; phosphorus oxychloride; trimetaphosphate; mixed anhydrides of acetic and di- or tri-basic carboxylic acids; vinyl sulfone; diepoxides; cyanuric chloride; hexahydro- 1,3,5-trisacryloyl-s-triazine; hexamethylene diisocyante; toluene 2,4-diisocyanate; N,N-dimethylene-bisacrylamide; N,N'-bis (hydroxymethyl)ethyleneurea; phosgene; tripolyphosphate; mixed carbonic-carboxylic acid anhydrides; imidazolides of carbonic and polybasic carboxylic acids; imidazolium salts of polybasic carboxylic acids; guanidine derivatives of polycarboxylic acids; esters of propynoic acid; aldehydes (e.g., formaldehyde, acetaldehyde and acrolein); carbamoyl ammonium salts (e.g., carbamoyl pyridinium salts). The use of these and similar crosslinking agents are disclosed in Rowland et al U.S. Pat. No. 2,113,034; Felton et al U.S. Pat. No. 2,328,537; Pierson U.S. Pat. No. 2,417,611; Caldwell U.S. Pat. No. 2,461,139; Fenn U.S. Pat. No. 2,469,957; Schoene et al U.S. Pat. No. 2,524,400; Caldwell et al U.S. Pat. No. 2,626,257; Kerr et al U.S. Pat. Nos. 2,438,855, 2,801,242, 2,852,393 and 2,938,901; Hofreiter et al U.S. Pat. No. 2,929,811, Senti et al U.S. Pat. No. 2,989,521; Comerford et al U.S. Pat. No. 2,977,356; Gerwitz U.S. Pat. No. 2,805,220; Wimmer U.S. Pat. No. 2,910,467; Trimmell et al U.S. Pat. Nos. 3,035,045 and 3,086,971; Sowell et al U.S. Pat. No. 3,001,985; Smith et al U.S. Pat. No. 3,069,410; Jarowenko et al U.S. Pat. No. 3,376,287; Speakman U.S. Pat. Nos. 3,549,618 and 3,705,046; Jarowenko U.S. Pat. No. 3,553,195; Tessler et al U.S. Pat. Nos. 3,699,095 and 3,728,332; Himmelmann U.S. Pat. No. 3,880,665; Ballantine et al U.S. Pat. No. 4,014,862; Tessler U.S. Pat. Nos. 4,020,272 and 4,098,997; Himmelmann et al U.S. Pat. No. 4,063,952; and Besio et al U.S. Pat. No. 5,482,827; the disclosures of which are here incorporated by reference. Quite commonly a hardener is introduced in one hydrophilic colloid layer and diffuses through all hydrophilic colloid layers coated on the same side of the support. All subsequent references to vehicles in the photographic elements of the invention should be understood to include hardeners associated with the vehicles.

In most instances each radiation-sensitive emulsion layer contains an antifoggant or stabilizer. Conventional antifoggants and stabilizers are illustrated by *Research Disclosure,* Item 36544, cited above, VII. Antifoggants and stabilizers.

Although the invention is described above in terms of the simplest possible photographic element construction, Element I above, consisting of a single radiation-sensitive silver halide emulsion layer and a support, it is appreciated that the invention can be readily applied to other typical photographic (including radiographic) element constructions. The following are illustrative of common, varied types of alternative element constructions:

| (Element II) |
|---|
| Overcoat<br>Siiver Halide Emulsion Layer Unit<br>Support<br>Backing Layer |

| (Element III) |
|---|
| Overcoat<br>Silver Halide Emulsion Layer Unit<br>Crossover Reduction Layer<br>Transparent Support<br>Crossover Reduction Layer<br>Silver Halide Emulsion Layer Unit<br>Overcoat |

| Element IV) |
|---|
| Overcoat<br>Third Dye Image Providing Layer Unit<br>Second Interlayer<br>Second Dye Image Providing Layer Unit<br>First Interlayer<br>First Dye Image Providing Layer Unit<br>Antihalation Layer<br>Support<br>Backing Layer |

Each of the layer units in Elements II, III and IV contain at least one radiation-sensitive silver halide emulsion layer that shares the features of the silver halide emulsion layer of Element I described above. The layer units can each consist of a single radiation-sensitive silver halide emulsion layer, as described in Element I, or the layer units can contain two or three or more separate layers. For example, each of Elements II, III and IV can contain two or more superimposed radiation-sensitive silver halide emulsion layers differing in sensitivity. To increase speed in relation to granularity the fastest of the emulsion layers is typically coated to receive exposing radiation prior to any other emulsion layer in the layer unit. When the slowest emulsion layer is coated to receive radiation prior to any other emulsion layer in the layer unit, increased contrast is realized.

The overcoat layers of Elements II, III and IV contain a hydrophilic colloid vehicle. Preferably the hydrophilic colloid contains both starch derived and gelatin derived hydrophilic colloid vehicle in the proportions described above in connection with the silver halide emulsion layer. In addition, the overcoats are convenient locations for incorporating various addenda for enhancing physical properties, such as those illustrated by *Research Disclosure,* Item 36544, cited above, IX. Coating physical property modifying addenda, A. Coating aids, B. Plasticizers and lubricants, C. Antistats, and D. Matting agents.

When the supports incorporated in Elements II and IV are flexible, the backing layers in these elements are typically relied upon to perform an anticurl function—that is, to offset the physical forces exerted on the support by the hydrophilic colloid layers coated on the opposite side of the support. In their simplest form the backing layers can consist of a hydrophilic colloid of the same type coated on the opposite side of the support. Since the backing layers are, like the overcoats previously described, surface layers, the backing layers can also or alternatively contain one or more of the various addenda described above in connection with the overcoats.

The backing layers also provide an ideal location for one or more processing solution decolorizable antihalation dyes. In Element II it is specifically contemplated to incorporate an antihalation dye in the backing layer. In Element IV a separate antihalation layer is shown interposed between the support and the image forming layer units. The antihalation layer of Element IV is typically comprised of a hydrophilic colloid and one more antihalation dyes, but addenda best suited for surface layers are typically absent. The antihalation layer of Element IV can be omitted, allowing the antihalation function to be formed alternatively by incorporating one or more antihalation dyes in the backing layer of Element IV. In Element III the crossover reduction layers can be constructed similarly as the antihalation layer in Element IV. Generally the same dyes are useful for reducing both halation and crossover. Antihalation and crossover reduction dyes are illustrated by *Research Disclosure,* Item 36544, cited above, VIII. Absorbing and scattering materials, B. Absorbing materials.

Except for the substitution of starch derived hydrophilic colloid in the proportions described above, radiographic elements, typically exhibiting the layer configuration of Elements II and III, can be constructed in a conventional manner, as illustrated by the following, the disclosures of which are here incorporated by reference:

RE-1 Dickerson U.S. Pat. No. 4,414,304
RE-2 Abbott et al U.S. Pat. No. 4,425,425
RE-3 Abbott et al U.S. Pat. No. 4,425,426
RE-4 Kelly et al U.S. Pat. No. 4,803,150
RE-5 Kelly et al U.S. Pat. No. 4,900,652
RE-6 Dickerson et al U.S. Pat. No. 4,994,355
RE-7 Dickerson et al U.S. Pat. No. 4,997,750
RE-8 Bunch et al U.S. Pat. No. 5,021,327
RE-9 Childers et al U.S. Pat. No. 5,041,364
RE-10 Dickerson et al U.S. Pat. No. 5,108,881
RE-10 Tsaur et al U.S. Pat. No. 5,252,442
RE-11 Dickerson et al U.S. Pat. No. 5,252,443
RE-12 Steklenski et al U.S. Pat. No. 5,259,016
RE-13 Dickerson U.S. Pat. No. 5,391,469

A further summary of conventional radiographic element components can also be found in *Research Disclosure,* Vol. 184, August 1979, Item 18431.

Although any one of Elements I, II, III and IV can be constructed to form dye images, most typically the layer configurations of Elements I, II and III are employed in silver image forming photographic elements. When Elements I and II are employed as black-and-white photographic elements, the silver halide emulsions they contain are typically orthochromatically or panchromatically sensitized. When Elements I, II and III are employed as radiographic elements or as duplicating elements, they are most commonly spectrally sensitized to match the peak emission spectrum of an intensifying screen or the wavelength of a laser exposure beam.

Element IV layer configurations are most typically employed for forming multicolor images. Each of the first, second and third dye image forming layer units is spectrally sensitized to a different one of the blue, green and red regions of the spectrum. In addition to spectrally sensitized radiation-sensitive silver halide grains, each layer unit contains a dye image providing component. For reproducing as a positive or negative the natural color of objects photographed the blue recording layer unit contains a yellow dye image providing component, the green recording layer unit contains a magenta dye image providing component, and the red recording layer unit contains a cyan dye image providing component. The dye image providing component can be coated in the same layer as the radiation-sensitive silver halide grains of the layer unit or in an adjacent layer.

The dye image providing component can take any convenient conventional form, such as any of those disclosed in *Research Disclosure,* Item 36544, cited above, X. Dye image formers and modifiers. In a specifically preferred form the dye image providing component includes a dye-forming coupler, such a coupler of the type illustrated by X., cited above, B. Image dye-forming couplers. Dye image modifiers, illustrated by X., cited above, C. Image dye modifiers, are commonly employed in combination to improve dye image properties. Many components employed in dye imaging, particularly ballasted dye-forming couplers and dye image modifiers, lack sufficient water solubility to be conveniently coated directly in hydrophilic colloid vehicles. It is conventional practice to introduce these components as solid particles or in droplets of a solvent that forms a discontinuous dispersed phase within the hydrophilic colloid-e.g., in coupler solvent droplets. Conventional techniques for dispersing dyes, dye precursors and other addenda having similar physical properties are illustrated by *Research Disclosure,* Item 36544, X., cited above, E. Dispersing dyes and dye precursors. It is conventional practice to disperse a high boiling solvent (e.g., a coupler solvent) containing the component sought to be dispersed in a hydrophilic colloid using a colloid mill. This mixture can be coated as a separate hydrophilic colloid layer of the layer unit or blended into a silver halide emulsion prior to coating. It is contemplated that the hydrophilic colloid vehicle associated with either or both of the silver halide emulsion and the dye imaging providing component or components prior to coating can be chosen to satisfy the gelatin derived and starch derived hydrophilic colloid proportions required by this invention. Alternatively, the starch derived and gelatin derived hydrophilic colloids can be distributed in any desired proportion before blending, so long as the proportions of the starch derived and gelatin derived hydrophilic colloids satisfy the requirements of the invention in the final coating composition.

In Element IV the first and second interlayers can be comprised of any conventional hydrophilic colloid vehicle and additionally include an antistain agent (e.g., an oxidized developing agent scavenger) to reduce color contamination attributable to oxidized developing agent wandering out of the layer unit in which it first becomes oxidized. Antistain agents are illustrated by *Research Disclosure,* Item 36544, X., cited above, D. Hue modifiers/stabilizers. Paragraph D also illustrates dye image stabilizers that are conventionally contained in the dye image providing layer units.

One or both of the interlayers can also contain an absorber to reduce color contamination on exposure. For example, when radiation-sensitive silver halide grains in each of the dye image forming layer units possess significant blue sensitivity, it is conventional practice to coat the layer unit intended to record blue light nearest the source of exposing radiation and to interpose an interlayer containing a blue absorber, such Carey Lea silver or a processing solution bleachable yellow dye between the blue recording layer unit and the remaining layer units. The blue absorber location corresponds to the second interlayer in Element IV. It is appreciated that first dye image providing layer can also be protected from unwanted blue exposure by also incorporating the blue absorber in the first interlayer. Suitable blue absorbing dyes are included among dyes disclosed in *Research Disclosure,* Item 36544, VIII., cited above, C. Absorbing materials.

Element V further illustrates contemplated multicolor photographic element constructions:

| (Element V) |
|---|
| Overcoat |
| Blue Recording Layer Unit |
| Second Interlayer |
| Green Recording Layer Unit |
| First Interlayer |
| Red Recording Layer Unit |
| Support |
| Backing Layer |

In Element V differs from Element IV in showing the most commonly used sequence of layer units. These layer units can, of course, be coated in any order when radiation-sensitive silver halide grains are employed in the green and red recording layer units that lack significant native blue sensitivity. Element V also differs from Element IV it that it is contemplated that the dye image providing materials need not be incorporated in the element to form dye images. As is well understood in the art, soluble dye-forming components can be introduced during processing.

The invention is applicable to conventional variations of multicolor photographic Elements IV and V. Specific constructions and variations adapted for differing end uses are illustrated by *Research Disclosure,* Item 36544, cited above:

XI. Layers and layer arrangements;

XII. Features applicable only to color negative;

XIII. Features applicable only to color positive
- A. Direct-positive imaging
- B. Color reversal
- C. Color-positives derived from color negatives;

XIV. Scan facilitating features, particularly paragraph (1).

The invention is also fully applicable to both silver and dye image transfer systems, such as those illustrated by *Research Disclosure,* Vol. 123, July 1974, Item 12331; Vol. 151, Nov. 1976, Item 15162; and Vol. 308, December 1989, Item 308119, XXIII. Image-transfer systems.

In the photographic elements of the invention it is preferred that each of the layers containing a hydrophilic colloid contain sufficient gelatin derived vehicle to insure a chill setting capability for the layer. To satisfy that capability and concurrently minimize gelatin requirements, it is preferred that each of the layer substitute for gelatin derived vehicle starch derived vehicle in the proportions described above in connection with Element I. Thus, the proportions of gelatin derived vehicle and starch derived vehicle described above for the radiation-sensitive silver halide emulsion layer of Element I apply equally to the overall proportions of these vehicles in all of the photographic elements described above. However, it is recognized that the advantages of the invention can be realized to the extent that even a single hydrophilic colloid vehicle containing layer contains the starch derived starch in the proportions contemplated.

The photographic elements of the invention can be imagewise exposed in any convenient conventional manner, since the starch derived vehicle is transparent throughout the visible and near ultraviolet regions of the spectrum. Conventional exposures of photographic elements are illustrated by *Research Disclosure,* Item 36544, cited above, XVI. Exposure. X-ray intensifying screen exposure of radiographic elements is illustrated in RE-1 through RE-13 and *Research Disclosure,* Item 18431, cited above.

The partial substitution of starch derived vehicle for gelatin derived vehicle in the photographic elements of the invention introduces no significant modification of processing capabilities. Thus, conventional techniques for processing are fully applicable to the photographic elements of the invention. Processing related features are illustrated by *Research Disclosure,* Item 36544, cited above:

XVII. Physical development systems;

XVIII. Chemical development systems
- A. Non-specific processing features
- B. Color-specific processing features;

XIX. Development
- A. Developing agents
- B. Preservatives
- C. Sequestering agents
- E. Other additives;

XX. Desilvering, washing and stabilizing
- A. Bleaching
- B. Fixing
- C. Bleach-fixing
- D. Washing, rinsing and stabilizing.

EXAMPLES

The invention can be better appreciated by reference to the following specific embodiments, wherein, mmole= millimole; wgt.=weight; all wgt. percentages are based on total wgt., unless otherwise stated; halide percentages in silver halide are mole percentages based on silver:

Emulsion 1

A starch solution was prepared by heating at 90° C. for 45 min a stirred 8,000 g aqueous mixture containing 54 mmole NaBr and 160 g of an oxidized cationic waxy corn starch, prepared starting with waxy corn starch STA-LOK® 140, which is 100% amylopectin that had been treated to contain quaternary ammonium groups and oxidized with 2 wgt % chlorine bleach. It contains 0.31 wgt % nitrogen and 0.00 wgt % phosphorous. STA-LOK® 140 was obtained from A. E. Staley Manufacturing Co., Decatur, Ill.

The resulting solution was cooled to 40° C., readjusted to 8,000 g with distilled water, and then 0.294 mole of sodium acetate and 28 mg of Pluronic®-L43 were added. (Pluronic®-L43 was obtained from BASF Corp. and has the following formula; $HO(CH2—CH_2O)_6(CH_2—CH(CH_3)O)_{22}—(CH_2—CH_2O)_6H$.) To a vigorously stirred reaction vessel of the starch solution at 40° C., pH 5.0, were added 4M $AgNO_3$ solution and 4M NaBr solution, each at a constant rate of 200 mL per min. After 0.2 min., the addition of the solutions was stopped, 100 mL of 2M NaBr was added rapidly, and the temperature of the contents of the reaction vessel was increased to 60° C. at a rate of 5° C. per 3 min; then 40 mmoles of ammonium sulfate solution were added and the pH of the contents was adjusted to 10.6 in 2 minutes using 2.5M NaOH solution. After 9 additional minutes at pH 10.6, the contents were adjusted to a pH of 5.0 using 4M $HNO_3$ and maintained at this value throughout the remainder of the precipitation. A 1M $AgNO_3$ solution was added at 10 mL per min and its addition rate was accelerated to reach a flow rate of 80 mL per min in 78 min. A 1.09M NaBr solution was concurrently added at a rate needed to maintain a constant pBr of 1.44. After 3,000 mL of the 1M $AgNO_3$ solution had been added, its addition was stopped but the addition of the NaBr solution was continued at 80 mL per min until the pBr was 1.13. Then 760 mL of a 0.125M KI solution were added at 80 mL per min. One minute after the addition of this KI solution was complete, 560 mL of the 1M $AgNO_3$ solution was added at 80 mL per min. The emulsion was cooled to 40° C. and finally washed by diafiltration to a pBr of 3.34.

The resulting 2.5 mole% iodide AgIBr tabular grain emulsion contained tabular grains with an average ECD of 1.9 μm, an average thickness of 0.08 μm, and an average aspect ratio of 24. The tabular grain population made up 98% of the total projected area of the emulsion grains.

Chemical and Spectral Sensitization

To 0.35 Ag mole of Emulsion 1, at 40° C., with stirring, a sodium acetate solution was added (31 mmole per Ag mole) and the pH of the emulsion was adjusted to 5.6. Then sequentially the following solutions of these salts were added so that the emulsion contained in units of mmole/Ag mole: 2.5 of NaSCN, 0.22 of a benzothiazolium salt, 1.2 of anhydro-5,5'-dichloro-3,3'-bis(3-sulfopropyl)thiacyanine hydroxide triethylammonium salt, and 0.08 of 1-(3-acetamidophenyl)-5-mercaptotetrazole sodium salt, 0.021 of 1,3-dicarboxymethyl-1,3-dimethyl-2-thiourea and 0.0084 of bis(1,3,5-trimethyl-1,2,4-triazolium-3-thiolate) gold (I) tetrafluoroborate. The mixture was heated to 55° C. at a rate of 1.67 ° C./min, and held at 55° C. for 15 min. Upon cooling to 40° C., a solution of 1.68 mmole per Ag mole of 5-bromo-4-hydroxy-6-methyl-1,3,3a,7-tetraazaindene was added. The final silver content of the emulsion was 1.68 kg of emulsion per mole of silver.

EXAMPLE 1

Photographic Coating Having as Protective Colloid 50 wgt % Starch and 50 wgt % Gelatin A starch solution was prepared by heating for 30 min at 80° C. with stirring 3.60 g of FILMKOTE® 54 in 90 g distilled water. (The anionic starch, FILMKOTE® 54, obtained from National Starch and Chemical Co., Bridgewater, N.J. is a corn starch consisting of approximately 25% amylose and 75% amylopectin and treated with octenylsuccinic anhydride.) The resulting solution was sonicated at 80° C. to disperse any remaining starch agglomerations and vacuum filtered through Whatman filter paper grade no. 2. To 55 g of the 4 wgt % starch solution at 40° C. were added 18.2 g of an 8 wgt % gelatin solution and 14.4 g of a coupler dispersion that contained 1.15 g of gelatin, 1.3 g of yellow dye-forming coupler Y-1, 1.3 g of coupler solvent dibutyl phthalate and 0.11% of Alkonol® XC (a mixture of i-propyl substituted naphthalene-2-sulfonic acids, available from E. I. DuPont de Nemours and Co. Inc.). The total weight of this mixture was adjusted to 105 g with distilled water. Then 15.2 g of Emulsion 1 sensitized as described above were added and the pH was adjusted to 6.0. Then 5 mL of a solution containing 340 mg of the anionic surfactant Triton® X-200 (octylphenoxy polyethoxyethanol obtained from Union Carbide Corp., Danbury, Conn.) and 2.5 mL of a solution containing 250 mg Olin®10G (nonylphenoxy polyglycerol obtained from Olin Corp., Norwalk Conn.) were added. Just before coating, 10 mL of a solution containing 180 mg bis(vinylsulfonyl)methane were added as hardener. The resulting mixture was machine coated at 108 g per square meter. The coating machine used a slide hopper to put the emulsion mixture onto the support then the resulting coating traveled into a 4° C. chill settng section for 3 min then into a drying section at 27° C. and a relative humidity of <20%. The calcualted coverage was 2.01 g per square meter starch, 2.01 g per square meter gelatin, 0.75 g per square meter silver, 1.00 g per square meter coupler, and 1.00 g per square meter coupler solvent.

Y-1

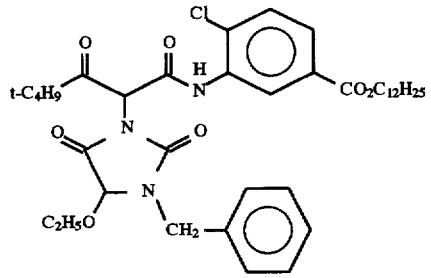

A coating was exposed through a density graduated step-tablet and processed in Kodak Flexicolor C-41™ color negative process using a development time of 3 min 15 sec. The results are summarized in Table I.

EXAMPLE 2

Photographic Coating Having as Protective Colloid 50 wgt % Starch and 50 wgt % Gelatin This example was prepared similarly to that of Example 1, except that the starch used was STARPOL® 560. This starch derivative is a nonionic water soluble hydroxypropyl substituted starch obtained from A. E. Staley Manufacturing Co., Decatur, Ill.

The results are summarized in Table I.

EXAMPLE 3

Photographic Coating Having as Protective Colloid 50% Starch and 50% Gelatin This example was prepared similarly to that of Example 1, except that the starch used was a water soluble potato starch prepared using the Lintner method (an acid treatment). It was obtained from Sigma Chemical Co., St. Louis Mo.

The results are summarized in Table I.

EXAMPLE 4

Photographic Coating Having as Protective Colloid 50% Starch and 50% Gelatin This example was prepared similarly to that of Example 1, except that the coating surfactants added to the melt were solutions containing 85 mg Duponol® ME (sodium lauryl sulfate from Witco Corp., Greenwich Conn.) and 131 mg Barquat® CME (a cationic surfactant from Lonza Inc., Fair Lawn, N.J.

The results are summarized in Table I.

CONTROL 5

Photographic Coating Having as Protective Colloid 7.5% Starch and 92.5% Gelatin

This control was prepared similarly to Example 1, except that in place of the 4 wgt % starch (FILMKOTE® 54) solution, a 4 wgt % bone gelatin solution was substituted.

The results are summarized in Table I.

TABLE I

| Coating | Wgt % Starch | Wgt % Gelatin | Dmin | Dmax | Mid-Scale Contrast | Relative Speed at 0.2 above Dmin | Retained Silver at Dmax ($g/m^2$) |
|---|---|---|---|---|---|---|---|
| Example 1 | 50 | 50 | 0.08 | 2.09 | 1.74 | 105 | <0.02 |
| Example 2 | 50 | 50 | 0.09 | 2.30 | 1.72 | 125 | <0.02 |
| Example 3 | 50 | 50 | 0.08 | 2.28 | 1.71 | 112 | <0.02 |
| Example 4 | 50 | 50 | 0.06 | 2.17 | 1.48 | 117 | <0.02 |
| Control 5 | 7.5 | 92.5 | 0.07 | 2.31 | 1.87 | 100 | <0.02 |

Table I illustrates that the various forms of starch derived hydrophilic colloid vehicle substituted for gelatin provided approximately similar photographic performance. The mid-scale contrast of the 100 wgt % gelatin vehicle coating was somewhat higher than that observed when starch derived hydrophilic colloid was partially substituted. On the other hand, higher speeds ranging up to almost a full stop (0.30 log E) were observed when starch derived hydrophilic colloid was partially substituted. Speed was measured at a density of 0.2 above minimum density. A relative speed difference of 1 is equal to 0.01 log E, where E represents exposure in lux-seconds.

All of the coatings produced demonstrated a chill setting capability in the coating machine described above. Thus, substitution of the starch derived hydrophilic colloid, offering the advantages of less complex preparation, greater availability and more easily controlled uniformity, showed the same desirable physical properties in preparing the photographic elements as the control employing gelatin as the sole hydrophilic colloid vehicle.

The low retained silver levels measured in areas receiving maxium exposure demonstrated that the starch derived vehicle did not interfere with image silver bleaching and fixing during processing at the level of 50 wgt % of hydrophilic colloid.

CONTROL 6

Attempt to Make Photographic Coating Having as Protective Colloid 60% Starch and 40% Gelatin This control was prepared similarly to that of Example 1, except that 68.3 g of the 4 wgt % starch solution and 11.6 g of the 8 wgt % gelatin solution were used.

The resulting mixture was machine coated at 108 g per square meter. The mixture did not chill-set at the chill-set station of the coating machine and therefore did not produce a uniform dried coating. The resulting coating was non-uniform, rendering it unacceptable for photographic uses.

CONTROL 7

Photographic Coating Having as Protective Colloid 6% Starch and 94% Gelatin

The coating of this control was prepared similarly to that of Example 1, except that the starch solution was replaced with distilled water. The only starch added was that present in sensitized Emulsion 1—i.e., the peptizer used to prepare the emulsion. The total gelatin concentration was the same as that of Example 1. The resulting mixture was 1.86 wgt % gelatin and 0.28 wgt % starch.

The resulting mixture was coated as in Example 1. The resulting coating had significant streaks making the coating non-uniform and unusable. No photographic testing could be performed.

This demonstrates that merely removing gelatin without substituting an alternative hydrophilic colloid is not a viable option for reducing the amount of gelatin required in preparing a photographic element.

CONTROL 8

Photographic Coating Having as Protective Colloid 79 wgt % Starch and 21 wgt % Gelatin A starch solution was prepared by boiling for 30 min 1.39 g FILMKOTE® 54 in 49 g distilled water with stirring. Then at 80° C., the resulting solution was sonicated to disperse any remaining starch agglomerations. At 40° C. a coupler dispersion was added containing 0.40 g of gelatin, 0.45 g of yellow dye-forming coupler Y-1 and 0.45 g of coupler solvent dibutyl phthalate. The pH was adjusted to 6.0, then 3.44 mmoles of sensitized Emulsion 1 were added (containing 0.15 g of starch). The total weight of this mixture was made to 60 g with distilled water. To a 12 g portion was added a solution containing 28.5 mg of 1-[(diethylamine)carbonyl]-4-(2-sulfoethyl)pyridinium hydroxide as hardener and solutions containing 8.5 mg Duponol® ME and 12.5 mg hexadecyltrimethylammonium chloride as surfactants. The pH was adjusted to 6.0. The mixture was hand-coated on gelatin-subbed Estar® poly (ethylene terephthalate) film support at a layer thickness so that the coating was 3.76 $g/m^2$ starch, 0.98 $g/m^2$ gelatin, 0.91 $g/m^2$ Ag, 1.10 $g/m^2$ coupler and 1.10 $g/m^2$ coupler solvent. From Control 6 it was realized that the composition, lacking a chill setting capability, could not be coated using the coating machine described above.

A 35 mm strip, cut from the coating, was exposed through a density graduated step-tablet and processed in Kodak Flexicolor C-41™ color negative process using a development time of 3 min 15 sec. A yellow negative image of the graduated step-tablet resulted. It had Dmax density of 1.38, Dmin density of 0.14 and mid-scale contrast of 0.63. The retained silver at Dmax density was measured by x-ray fluorescence and found to be 0.17 $g/m^2$. This demonstrated that the high level of starch derived hydrophilic colloid was interfering with silver bleaching.

CONTROL 9

Photographic Coating Having as Protective Colloid 100% Starch, Coupler Dispersion, Made in Starch A starch solution was prepared by heating at 80° C. for 30 min 3.58 g FILMKOTE® 54 in 105.4 g distilled water.

Starch Solution A

One 54.5 g portion of the starch solution was sonicated at 80° C. to disperse any remaining starch agglomerates and then filtered at 40° C.

Coupler Dispersion A

To other 54.5 g portion of the starch solution at 80° C. were added 0.9 g of a yellow dye-forming coupler Y-1 dissolved in 0.9 g of a coupler solvent tris(methylphenyl) phosphate heated to 120° C. At 80° C. the mixture was sonicated to make a coupler dispersion in which the coupler-solvent droplets were <2 μm and generally <1 μm.

A coating melt was prepared by mixing at 40° C. 10.8 g of Coupler Dispersion A, 10.8 g of Starch Solution A, 2.06 g of sensitized Emulsion 1, 0.25 mL of a solution containing 57 mg of 1-[(diethylamine)carbonyl]-4-(2-sulfoethyl) pyridiniumhydroxide hardener, 0.5 mL of a solution containing 16.9 mg Duponol®ME and 0.5 mL of a solution containing 20 mg of Barquat®CME. The coating melt pH was adjusted to 6.0 at 40° C. It was then hand-coated on gelatin-subbed Estar® support at a coverage of 151 g/m$^2$of coating melt. The composition could not be chill set using the coating machine described above.

A 35 mm strip, cut from the coating, was exposed through a density graduated step-tablet and processed in Kodak Flexicolor C-41™ color negative process using a development time of 3 min 15 sec. A yellow negative image of the graduated step-tablet resulted. It had Dmin density of 0.43, Dmax density of 1.11, and mid-scale contrast of 0.37. Log speed relative to Example 10 was 95. The retained silver at Dmax was 0.12 g/m$^2$ meter, demonstrating that the starch derived hydrophilic colloid was interfering with silver bleaching and fixing.

EXAMPLE 10

Photographic Coating Having as Protective Colloid 50 wgt % Starch and 50 wgt % Gelatin. Coupler Dispersion Made in Starch This example was prepared similarly to that of Control 9, except that the 10.8 g of Coupler Dispersion A was mixed with 10.8 g of a 3.9 wt % bone gelatin solution instead of Starch Solution A. After the coating was exposed and processed as in Control 9, the yellow negative image had the following values: Dmin 0.09, Dmax 0.97, mid-scale contrast 0.61, log speed 100. The retained silver at Dmax was <0.02 g per square meter.

EXAMPLE 11

Solutions of Colloids Containing 45% Gelatin and 55% Starches of Varying Portions of Cationic Starch Four solutions were prepared that contained 2 wgt % of different colloids and adjusted to pH of 6.0.

Solution A was deionized bone gelatin.

Solution B was the nonionic starch derivative STAR-POL®560.

Solution C was the anionic starch derivative FILMKOTE®54.

Solution D was the cationic starch derivative STA-LOK®140.

At 40° C., Solution A, B and D, or A, C and D were mixed as shown below in Table II and 0.1 mole of sensitized Emulsion 1 was added. Portions of each mixture were examined by optical microscopy for colloid precipitation and significant grain conglomeration. No colloid precipitation and no significant silver halide grain conglomeration was found in any of the 14 mixtures.

TABLE II

| Sample | Sol. A (g) | Sol B (g) | Sol C (g) | Sol D (g) | % Gel | % Non-Cationic Starch | % Cationic Starch |
|---|---|---|---|---|---|---|---|
| 1 | 9 | 11 | — | 0 | 45 | 54 | 1 |
| 2 | 9 | 9 | — | 2 | – | 44 | 11 |
| 3 | 9 | 7 | — | 4 | " | 34 | 21 |
| 4 | 9 | 5 | — | 6 | " | 24 | 31 |
| 5 | 9 | 3 | — | 8 | " | 14 | 41 |
| 6 | 9 | 2 | — | 10 | " | 4 | 51 |
| 7 | 9 | 0 | — | 11 | " | 0 | 55 |
| 8 | 9 | — | 11 | 0 | " | 54 | 1 |
| 9 | 9 | — | 9 | 2 | " | 44 | 11 |
| 10 | 9 | — | 7 | 4 | " | 34 | 21 |
| 11 | 9 | — | 5 | 6 | " | 24 | 31 |
| 12 | 9 | — | 3 | 8 | " | 14 | 41 |
| 13 | 9 | — | 1 | 10 | " | 4 | 51 |
| 14 | 9 | — | 0 | 11 | " | 0 | 55 |

EXAMPLES 12 THROUGH 28

These examples demonstrate the precipitation of tabular grain emulsions using a cationic starch derived from different plant sources, including a variety of potato and grain sources. The starches were selected to demonstrate a wide range of nitrogen and phosphorus contents. Variations in emulsion precipitation conditions are also demonstrated. Particularly significant is the demonstration that all of the cationic starch used for the entire precipitation can be added prior to grain nucleation.

EXAMPLE 12

AgIBr (3 mole % I) Tabular Grain Emulsion Made Using a Cationic Potato Starch A starch solution was prepared by boiling for 30 min a stirred mixture of 80 g cationic potato starch (STA-LOK® 400, obtained from A. E. Staley Manufacturing Co., Decatur, Ill.), 27 mmoles of NaBr, and distilled water to 4 L. The cationic starch was a mixture of 21% amylose and 79% amylopectin and contained 0.33 wt % nitrogen in the form of a quaternary trimethyl ammonium alkyl starch ether and 0.13 wt % natural phosphorus. The cationic starch had an average molecular weight is 2.2 million. The resulting solution was cooled to 35° C., readjusted to 4 L with distilled water, and the pH was adjusted to 5.5. To a vigorously stirred reaction vessel of the starch solution at 35° C., a 2M $AgNO_3$ solution was added at 100 mL per min for 0.2 min. Concurrently, a salt solution of 1.94M NaBr and 0.06M KI was added initially at 100 mL per min and then at a rate needed to maintain a pBr of 2.21. Then the addition of the solutions was stopped, 25 mL of 2M NaBr solution was added rapidly and the temperature of the contents of the reaction vessel was increased to 60° C. at a rate of 5° C. per 3 min. At 60° C., the $AgNO_3$ solution was added at 10 mL per min for 1 min then its addition rate was accelerated to 50 mL per min in 30 min until a total of 1.00 L had been added. The salt solution was concurrently added at a rate needed to maintain a constant pBr of 1.76. The resulting tabular grain emulsion was washed by diafiltration at 40° C. to a pBr of 3.38.

The tabular grain population of the resulting tabular grain emulsion was comprised of tabular grains with an average equivalent circular diameter of 1.2 μm, an average thickness of 0.06 μm, and an average aspect ratio of 20. The tabular grain population made up 92% of the total projected area of the emulsion grains. The emulsion grains had a coefficient of variation in diameter of 18%.

EXAMPLE 13

AgIBr (3 mole % I) Tabular Grain Emulsion Made Using a Cationic Corn Starch

A starch solution was prepared by boiling for 30 min a stirred 400 g aqueous mixture containing 2.7 mmoles of NaBr and 8.0 g of a cationic hybrid corn starch (CATO® 235, obtained from National Starch and Chemical Company, Bridgewater, N.J.) containing 0.31 wt % nitrogen and 0.00 wt % phosphorous.

The resulting solution was cooled to 35° C., readjusted to 400 g with distilled water. To a vigorously stirred reaction vessel of the starch solution at 35° C., pH 5.5 was added 2M $AgNO_3$ solution at a constant rate of 10 mL per min. Concurrently, a salt solution of 1.94M NaBr and 0.06M KI was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the $AgNO_3$ solution was added at 1.0 mL per min for 1 min then its addition rate was accelerated to reach a flow rate of 5 mL per min in 30 min until a total of 100 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.6 μm, an average thickness of 0.06 μm, and an average aspect ratio of 27. The tabular grain population made up 85% of the total projected area of the emulsion grains.

EXAMPLE 14

AgIBr (3 mole % I) Tabular Grain Emulsion Made Using a Cationic Amphoteric Potato Starch This emulsion was prepared similarly to Example 13, except that the starch used was a cationic amphoteric potato starch (Wespol A®, obtained from Western Polymer Corporation, Moses Lake, Wash.) containing both a quaternary trimethyl ammonium alkyl starch ether, 0.36 wt % nitrogen, and orthophosphate (0.70 wt % phosphorous) substituents.

The tabular grain population of the resulting emulsion was comprised of tabular grains with an average equivalent circular diameter of 1.7 μm, an average thickness of 0.05 μm, and an average aspect ratio of 34. The tabular grain population made up 95% of the total projected area of the emulsion grains.

EXAMPLE 15

AgIBr (3 mole % I) Tabular Grain Emulsion Made Using a Cationic Amphoteric Potato Starch This emulsion was prepared similarly to Example 14, except that the precipitation was stopped after 50 mL of the $AgNO_3$ solution was added.

The tabular grain population of the resulting emulsion was comprised of tabular grains with an average equivalent circular diameter of 1.0 μm, an average thickness of 0.045 μm, and an average aspect ratio of 25. The tabular grain population made up 95% of the total projected area of the emulsion grains.

EXAMPLE 16

AgIBr (3 mole % I) Tabular Grain Emulsion Made Using a Cationic Potato Starch and at pH 2.0.

This emulsion was prepared similarly to Example 13, except that the emulsion was precipitated at pH 2.0 and the starch used was cationic potato starch (STA-LOK® 400).

The tabular grain population of the resulting emulsion was comprised of tabular grains with an average equivalent circular diameter of 1.5 μm, an average thickness of 0.06 μm, and an average aspect ratio of 22. The tabular grain population made up 80% of the total projected area of the emulsion grains.

EXAMPLE 17

AgIBr (3 mole % I) Tabular Grain Emulsion Made Using a Cationic Corn Starch

This emulsion was prepared similarly to Example 13, except that the emulsion was precipitated at pH 6.0, and the starch used was a cationic waxy corn starch (STA-LOK® 180, obtained from A. E. Staley Manufacturing Co.) made up of 100% amylopectin derivatized to contain 0.36 wt % nitrogen in the form of a quaternary trimethyl ammonium alkyl starch ether and 0.06 wt % phosphorous, average molecular weight 324,000.

The tabular grain population of the resulting emulsion was comprised of tabular grains with an average equivalent circular diameter of 1.6 μm, an average thickness of 0.06 μm, and an average aspect ratio of 27. The tabular grain population made up 91% of the total projected area of the emulsion grains.

EXAMPLE 18

AgBr Tabular Grain Emulsion Made by Adding 94% of a Cationic Potato Starch After Grain Nucleation A starch solution was prepared by boiling for 30 min a stirred 200 g aqueous mixture containing 3.75 mmoles of NaBr and 8.0 g of the cationic potato starch STA-LOK® 400.

To a vigorously stirred reaction vessel of 12.5 g of the starch solution (0.5 g starch), 387.5 g distilled water, and 2.2 mmole of NaBr at pH of 6.0 and 35° C. was added 2M $AgNO_3$ solution at a constant rate of 10 mL per min. Concurrently, a 2.5M NaBr solution was added initially at 10 mL per min and then at a rate needed to maintain a pBr of 2.21. After 0.2 min, the addition of the solutions was stopped, 2.5 mL of 2M NaBr was added rapidly, and the temperature of the contents of the reaction vessel was increased to 60° C. at a rate of 5° C. per 3 min. At 60° C., 187.5 g of the starch solution (7.5 g starch) was added, the pH was adjusted to 6.0 and maintained at this value throughout the remainder of the precipitation, and the $AgNO_3$ solution was added at 1.0 mL per min for 3 min and the NaBr solution was concurrently added at a rate needed to maintain a pBr of 1.76. Then the addition of the NaBr solution was stopped but the addition of the $AgNO_3$ solution was continued at 1.0 mL per min until a pBr of 2.00 was obtained. Then the addition of the $AgNO_3$ was accelerated at 0.05 mL per min squared and the NaBr solution was added as needed to maintain a pBr of 2.00 until a total of 0.20 mole of silver had been added.

The tabular grain population of the resulting emulsion was comprised of tabular grains with an average equivalent circular diameter of 1.0 μm, an average thickness of 0.055 μm, and an average aspect ratio of 18. The tabular grain population made up 90% of the total projected area of the emulsion grains.

EXAMPLE 19

AgIBr (3 mole % I) Tabular Grain Emulsion Made Using a Cationic Amphoteric Corn Starch This emulsion was prepared similarly to Example 13, except that the starch used was a cationic amphoteric corn starch (STA-LOK® 356, obtained from A. E. Staley Manufacturing Co.) containing both a quaternary trimethyl ammonium alkyl starch ether (0.34 wt % nitrogen) and orthophosphate (1.15 wt % phosphorous) substituents. The cationic amphoteric starch was a mixture of 28% amylose and 72% amylopectin, with an average molecular weight of 486,000.

The tabular grain population of the resulting emulsion was comprised of tabular grains with an average equivalent circular diameter of 1.6 μm, an average thickness of 0.07 μm, and an average aspect ratio of 23. The tabular grain population made up 80% of the total projected area of the emulsion grains.

EXAMPLE 20

AgBr Tabular Grain Emulsion Made Using a Cationic Potato Starch

To a vigorously stirred reaction vessel containing 400 g of a solution at 35° C., pH 6.0 of 8.0 g cationic potato starch (STA-LOK® 400) and 6.75 mmolar in NaBr was added a 2M $AgNO_3$ solution at a rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly and the temperature was increased to 60° C. at a rate of 5° C. per 3 min. At 60° C., the $AgNO_3$ solution was added at 1.0 mL per min for 1 min then its addition rate was accelerated to 5 mL per min in 30 min then held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 2.2 μm, an average thickness of 0.08 μm, and an average aspect ratio of 28. The tabular grain population made up 85% of the total projected area of the emulsion grains.

EXAMPLE 21

AgIBr (3 mole % I) Tabular Grain Emulsion Made Using a Protonated Tertiary Aminoalkyl (Cationic) Corn Starch This emulsion was prepared similarly to Example 13, except that the starch used was a corn starch (CATO-SIZE® 69, obtained from National Starch and Chemical Co.) that, as obtained, was derivatized to contain tertiary aminoalkyl starch ethers, 0.25 wt % nitrogen, 0.06 wt % phosphorus. At a pH of 5.5, the tertiary amino groups were protonated to render the starch cationic.

The tabular grain population of the resulting emulsion was comprised of tabular grains with an average equivalent circular diameter of 1.2 μm, an average thickness of 0.08 μm, and an average aspect ratio of 15. The tabular grain population made up 55% of the total projected area of the emulsion grains.

EXAMPLE 22

AgIBr (3 mole % I) Tabular Grain Emulsion Made Using a Cationic Potato Starch and at pH 5.5 and 80° C.

This emulsion was prepared similarly to Example 13, except that the starch used was cationic potato starch (STA-LOK® 400) and the temperature was increased to 80° C. (instead of 60° C.).

The tabular grain population of the emulsion was comprised of tabular grains with an average equivalent circular diameter of 1.7 μm, an average thickness of 0.07 μm, and an average aspect ratio of 24. The tabular grain population made up 80% of the total projected area of the emulsion grains.

EXAMPLE 23

AgIBr (3 mole % I) Tabular Grain Emulsion Made Using a Cationic Corn Starch

This emulsion was prepared similarly to Example 13, except that the starch used was a cationic corn starch (CATO® 25, obtained from National Starch and Chemical Company) containing 0.26 wt % nitrogen and 0.00 wt % phosphorous.

The tabular grain population of the resulting emulsion was comprised of tabular grains with an average equivalent circular diameter of 1.2 μm, an average thickness of 0.07 μm, and an average aspect ratio of 17. The tabular grain population made up 65% of the total projected area of the emulsion grains.

EXAMPLE 24

AgIBr (3 mole % I) Tabular Grain Emulsion Made Using a Cationic Corn Starch

This emulsion was prepared similarly to Example 13, except that the starch used was a cationic corn starch (Clinton 788 ®, obtained from ADM Corn Processing, Clinton, Iowa) containing 0.15 wt % nitrogen and 0.00 wt % phosphorous.

The tabular grain population of the resulting emulsion was comprised of tabular grains with an average equivalent circular diameter of 1.0 μm, an average thickness of 0.08 μm, and an average aspect ratio of 13. The tabular grain population made up 60% of the total projected area of the emulsion grains.

EXAMPLE 25

AgIBr (3 mole % I) Tabular Grain Emulsion Made Using a Cationic Wheat Starch This emulsion was prepared similarly to Example 13, except that the starch used was a cationic wheat starch (K-MEGA® 53S, obtained from ADM/Ogilvie, Montreal, Quebec, Canada), which, as received was derivatized with a quaternary amine. The degree of substitution is 0.050 corresponding to 0.41 wt % nitrogen. The phosphorous was determined spectrophotometrically to be 0.07 wt %.

The tabular grain population of the resulting emulsion was comprised of tabular grains with an average equivalent circular diameter of 1.5 μm, an average thickness of 0.08 μm, and an average aspect ratio of 19. The tabular grain population made up 85% of the total projected area of the emulsion grains.

EXAMPLE 26

AgBr Tabular Grain Emulsion Made Using a Cationic Potato Starch

A starch solution was prepared by boiling for 30 min a stirred 400 g aqueous mixture containing 2.7 mmoles of NaBr and 8.0 g of the cationic potato starch STA-LOK® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a 2M NaBr solution was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 50° C. at a rate of 5° C. per 3 min. At 50° C., the pH was adjusted to 6.0 and the $AgNO_3$ solution was added at 1.0 mL per min for 1 min, then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76.

The tabular grain population of the resulting emulsion was comprised of tabular grains with an average equivalent circular diameter of 1.2 μm, an average thickness of 0.10 μm, and an average aspect ratio of 12. The tabular grain population made up 70% of the total projected area of the emulsion grains.

EXAMPLE 27

AgIBr (3 mole % I) Tabular Grain Emulsion Made Using a Cationic Potato Starch of High Nitrogen Content A cationic potato starch solution containing a high nitrogen content was supplied by Western Polymer Corporation. The starch was 1.10 wt % in nitrogen and 0.25 wt % in natural phosphorous.

To 40 g of the starch solution, which contained 8 g of starch, was added 360 g distilled water and 2.7 mmoles of NaBr. This solution was placed in a reaction vessel and used to precipitate this emulsion using the procedure described in Example 2.

The tabular grain population of the resulting emulsion was comprised of tabular grains with an average equivalent circular diameter of 1.2 μm, an average thickness of 0.09 μm, and an average aspect ratio of 13. The tabular grain population made up 80% of the total projected area of the emulsion grains.

EXAMPLE 28

AgBr Tabular Grain Emulsion Made Using a Cationic Potato Starch

A starch solution was prepared by boiling for 30 min a stirred 400 g aqueous mixture containing 2.7 mmoles of NaBr and 8.0 g of the cationic potato starch STA-LOK® 400.

The resulting solution was cooled to 35° C., readjusted to 400 g with distilled water. To a vigorously stirred reaction vessel of the starch solution at 35° C., pH 6.0 was added 2M $AgNO_3$ solution at a constant rate of 10 mL per min. Concurrently, a salt solution of 2.5M NaBr was added initially at 10 mL per min and then at a rate needed to maintain a pBr of 2.21. After 0.2 min., the addition of the solutions was stopped, 2.5 mL of 2M NaBr was added rapidly, and the temperature of the contents of the reaction vessel was increased to 60° C. at a rate of 5° C. per 3 min. At 60° C., the pH was adjusted to 6.0 and the $AgNO_3$ solution was added at 1.0 mL per min for 1 min then its addition rate was accelerated to reach a flow rate of 5 mL per min in 30 min and held at this rate until a total of 200 mL of the $AgNO_3$ solution had been added. The salt solution was concurrently added at a rate needed to maintain a constant pBr of 1.76. Then the addition of the NaBr solution was stopped and the flow rate of the $AgNO_3$ solution was dropped to 1 mL per min. When the pBr reached 2.28, the NaBr solution flow was resumed to maintain this pBr. After 60 min of growth at this pBr, the pBr was adjusted to 3.04 and maintained at this value until a total of 0.53 moles of silver had been added.

The tabular grain population of the resulting emulsion was comprised of tabular grains with an average equivalent circular diameter of 2.0 μm, an average thickness of 0.14 μm, and an average aspect ratio of 14. The tabular grain population made up 85% of the total projected area of the emulsion grains.

EXAMPLES 29 THROUGH 33

These examples demonstrate preparations of non-tabular grain emulsions resulting from choosing noncationic starches as peptizers.

EXAMPLE 29

AgIBr (3 mole % I) Nontabular Grain Emulsion Made Using a Water-Soluble Carboxylated (Noncationic) Corn Starch This emulsion was prepared similarly to Example 13, except that the starch used was a corn starch (FILMKOTE® 54, obtained from National Starch and Chemical Co.), which, as supplied, was derivatized to contain carboxylate groups. The nitrogen content was natural, 0.06 wt %.

A nontabular grain emulsion resulted.

EXAMPLE 30

AgIBr (3 mole % I) Nontabular Grain Emulsion Made Using a Water-Soluble Orthophosphate Derivatized (Noncationic) Potato Starch This emulsion was prepared similarly to Example 13, except that the starch used was an orthophosphate derivatized potato starch 0.03 wt % nitrogen (natural), and orthophosphate substituents, 0.66 wt % phosphorous. The sample was obtained from Western Polymer Corporation.

A nontabular grain emulsion resulted.

EXAMPLE 31

AgIBr (3 mole % I) Nontabular Grain Emulsion Made Using a Water-Soluble Hydroxypropyl-substituted (Noncationic) Corn Starch This emulsion was prepared similarly to Example 13, except that the starch (STARPOL® 530, was obtained from A. E. Staley Manufacturing Co.) used was a hydroxypropyl-substituted corn starch, 0.06 wt % nitrogen (natural) and 0.12 wt % phosphorous.

A nontabular grain emulsion resulted.

EXAMPLE 32

AgIBr (3 mole % I) Nontabular Grain Emulsion Made Using a Water-Soluble (Noncationic) Potato Starch This emulsion was prepared similarly to Example 13, except that the starch (Soluble Potato Starch obtained from Sigma Chemical Company, St. Louis, Mo.) used was a treated and purified water soluble potato starch, 0.04 wt % nitrogen and 0.06 wt % phosphorous.

A nontabular grain emulsion resulted.

EXAMPLE 33

AgIBr (3 mole % I) Nontabular Grain Emulsion Made Using a Water-Soluble (Noncationic) Wheat Starch This emulsion was prepared similarly to Example 13, except that the starch (Supergel® 1400, obtained from ADM/Ogilvie, Montreal, Quebec, Canada) used was a water soluble noncationic wheat starch.

A nontabular grain emulsion resulted.

CONTROLS 34 THROUGH 38

These controls demonstrate preparation failures resulting from choosing starch-like substances as peptizers.

CONTROL 34

AgIBr (3 mole % I) Nontabular Grain Emulsion Made Using the Grain Protein Zein This example demonstrates to the failure of the grain protein zein to act as a peptizer.

In a stirred reaction vessel, 8.0 g of zein (obtained from Sigma Chemical Co.) in 400 g distilled water containing 2.7 mmole of NaBr was boiled for 60 min. Most of the zein did not appear to dissolve. The mixture was filtered and the filtrate was used as the starch solution to precipitate silver halide using conditions similar to those used in Example 13.

The resulting precipitation resulted in large clumps of nontabular grains.

CONTROL 35

AgIBr (3 mole % I) Nontabular Grain Emulsion Made Using the Noncationic Polysaccharide Dextran This emulsion was prepared similarly to Example 13, except that the polysaccharide dextran (obtained from Sigma Chemical Co., St. Louis, Mo.), having a molecular weight of approximately 500,000, was employed.

The resulting precipitation resulted in large clumps of nontabular grains. Dextran was unable to peptize the silver halide grains.

CONTROL 36

AgIBr (3 mole % I) Nontabular Grain Emulsion Made Using the Noncationic Polysaccharide, Agar This emulsion was prepared similarly to Example 13, except that the polysaccharide used was agar (purified, ash content <2%), obtained from Sigma Chemical Co.

The resulting precipitation resulted in large clumps and isolated nontabular grains. Agar was a poor peptizer for silver halide grains.

CONTROL 37

AgIBr (3 mole % I) Nontabular Grain Emulsion Made Using the Noncationic Polysaccharide Pectin This emulsion was prepared similarly to Example 13, except that the polysaccharide used was pectin from citrus fruit (obtained from Sigma Chemical Co).

A nontabular grain emulsion resulted.

CONTROL 38

AgIBr (3 mole % I) Nontabular Grain Emulsion Made Using the Noncationic Polysaccharide, Gum Arabic This emulsion was prepared similarly to Example 13, except that the polysaccharide used was gum arabic (obtained from Sigma Chemical Co.), having a molecular weight of about 250,000.

A nontabular grain emulsion resulted.

TABLE III

Emulsion Summary

| Example (Control) | Peptizer | Cationic | Wt % Nitrogen | Wt % Phosphorus | Tabular Grains Present | Tabular Grains as % of Total Grain Projected Area |
|---|---|---|---|---|---|---|
| 12 | Potato Starch | Yes | 0.33 | 0.13[a] | Yes | 92 |
| 13 | Hybrd Corn S. | Yes | 0.31 | 0.00 | Yes | 85 |
| 14 | Potato Starch | Yes | 0.36 | 0.70 | Yes | 95 |
| 15 | Potato Starch | Yes | 0.36 | 0.70 | Yes | 95 |
| 16 | Potato Starch | Yes | 0.33 | 0.13[a] | Yes | 80 |
| 17 | Waxy Corn S. | Yes | 0.36 | 0.06[a] | Yes | 91 |
| 18 | Potato Starch | Yes | 0.33 | 0.13[a] | Yes | 90 |
| 19 | Potato Starch | Yes | 0.34 | 1.15 | Yes | 80 |
| 20 | Potato Starch | Yes | 0.33 | 0.13[a] | Yes | 85 |
| 21 | Corn Starch | Yes | 0.25 | 0.03[a] | Yes | 55 |

TABLE III-continued

Emulsion Summary

| Example (Control) | Peptizer | Cationic | Wt % Nitrogen | Wt % Phosphorus | Tabular Grains Present | Tabular Grains as % of Total Grain Projected Area |
|---|---|---|---|---|---|---|
| 22 | Potato Starch | Yes | 0.33 | 0.13[a] | Yes | 80 |
| 23 | Corn Starch | Yes | 0.26 | 0.00 | Yes | 65 |
| 24 | Corn Starch | Yes | 0.15 | 0.00 | Yes | 60 |
| 25 | Wheat Starch | Yes | 0.41[b] | 0.07[a] | Yes | 85 |
| 26 | Potato Starch | Yes | 0.33 | 0.13[a] | Yes | 70 |
| 27 | Potato Starch | Yes | 1.10 | 0.25[a] | Yes | 80 |
| 28 | Potato Starch | Yes | 0.33 | 0.13[a] | Yes | 85 |
| 29 | Corn Starch | No | 0.06[a] | 0.00 | No | 0 |
| 30 | Potato Starch | No | 0.03[a] | 0.66 | No | 0 |
| 31 | Corn Starch | No | 0.06[a] | 0.00 | No | 0 |
| 32 | Potato Starch | No | 0.04[a] | 0.06 | No | 0 |
| 33 | Wheat Starch | No | NM | NM | No | 0 |
| 34 | Zein | No | NM | NM | EP | 0 |
| 35 | Dextran | No | NM | NM | EF | 0 |
| 36 | Agar | No | NM | NM | EF | 0 |
| 37 | Pectin | No | NM | NM | EF | 0 |
| 38 | Gum Arabic | No | NM | NM | No | 0 |

[a]Natural content
[b]Calculated from the degree of substitution.
NM = Not Measured; NA = Not Applicable; EF = Emulsion preparation failure Table III demonstrates that peptizer derived from cationic starch produces tabular grain emulsions. Other forms of starch used as a peptizer results in grains that are not tabular. Many materials similar to starch failed as peptizers.

The invention has been described in detail with particular reference to preferred embodiments thereof, but it will be understood that variations and modifications can be effected within the spirit and scope of the invention.

What is claimed is:

1. A photographic element comprising a support and, coated on said support, at least one silver halide emulsion layer comprised of radiation-sensitive silver halide grains and hydrophilic colloid vehicle, wherein at least 45 percent of the total weight of the hydrophilic colloid vehicle is derived from gelatin and at least 20 percent of the total weight of the hydrophilic colloid vehicle is derived from a water dispersible starch.

2. A photographic element according to claim 1 wherein at least 30 percent of the total weight of the hydrophilic colloid vehicle is derived from a water dispersible starch.

3. A photographic element according to claim 1 wherein from 30 to 50 percent of the total weight of the hydrophilic colloid vehicle is derived from a water dispersible starch and at least 50 percent of the total weight of the hydrophilic colloid vehicle is derived from gelatin.

4. A photographic element according to claim 1 wherein at least 50 percent of total projected area of the radiation-sensitive silver halide grains provided by tabular grains and the hydrophilic colloid derived from starch is comprised of a water dispersible cationic starch present as a peptizer.

5. A photographic element according to claim 4 wherein the cationic starch contains gluopyranose repeating units and, on average, at least one oxidized α-D-gluopyranose unit per molecule.

6. A photographic element according to claim 5 wherein the oxidized cationic starch consists essentially of oxidized amylopectin cationic starch.

7. A photographic element according to claim 1 wherein said at least one radiation-sensitive silver halide emulsion layer contains tabular grains have {111} major faces and contain greater than 50 mole percent bromide, based on silver.

8. A photographic element according to claim 5 wherein the hydrophilic colloid vehicle derived from starch is present as a peptizer.

9. A photographic element according to claim 1 wherein a plurality of layers containing hydrophilic colloid vehicle are coated on the support and in-each of said layers (a) at least 45 percent of the total weight of the hydrophilic colloid vehicle is derived from gelatin and (b) at least 20 percent of the total weight of the hydrophilic colloid vehicle is derived from a water dispersible starch.

10. A photographic element according to claim 9 wherein hydrophilic colloid layers containing radiation-sensitive silver halide grains are coated on both major faces of the support.

11. A photographic element comprised of a support and, coated on the support, a blue recording layer unit containing blue sensitive silver halide grains, a green recording layer unit containing green sensitive silver halide grains, and a red recording layer unit containing red sensitized silver halide grains, and each of said layer units containing a hydrophilic colloid vehicle, wherein at least 45 percent of the total weight of the hydrophilic colloid vehicle is derived from gelatin and at least 20 percent of the total weight of the hydrophilic colloid vehicle is derived from a water dispersible starch.

12. A photographic element according to claim 11 wherein silver iodobromide {111} tabular grains and a peptizer consisting essentially of oxidized cationic starch are present in the green and red recording layer units.

13. A photographic element according to claim 11 wherein said support is a white reflective support.

* * * * *